US012529508B2

(12) United States Patent
Allard

(10) Patent No.: US 12,529,508 B2
(45) Date of Patent: Jan. 20, 2026

(54) TRIM BREAKER INTERFACE FOR REDUCING AIR INFILTRATION IN A VACUUM INSULATED APPLIANCE

(71) Applicant: WHIRLPOOL CORPORATION, Benton Harbor, MI (US)

(72) Inventor: Paul B. Allard, Coloma, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 195 days.

(21) Appl. No.: 18/450,680

(22) Filed: Aug. 16, 2023

(65) Prior Publication Data

US 2025/0060147 A1 Feb. 20, 2025

(51) Int. Cl.
*F25D 23/08* (2006.01)
*F25D 23/06* (2006.01)
*F25D 27/00* (2006.01)

(52) U.S. Cl.
CPC ..... *F25D 23/085* (2013.01); *F25D 23/062* (2013.01); *F25D 27/00* (2013.01); *F25D 2201/14* (2013.01)

(58) Field of Classification Search
CPC .... F25D 23/087; F25D 23/085; F25D 23/062; F25D 27/00; F25D 2201/14
See application file for complete search history.

(56) References Cited

U.S. PATENT DOCUMENTS 2,809,764 A * 10/1957 Diamond ..... F25D 23/085 220/592.06
3,405,987 A 10/1968 Pulaski
5,368,381 A * 11/1994 Mandel ..... F25D 23/082 312/406.2
5,876,104 A * 3/1999 Kunkel ..... F25D 23/085 220/592.25
9,879,900 B1 1/2018 Ammerman et al.
10,429,123 B1 10/2019 Stoops et al.
10,883,758 B2 1/2021 Jung et al.
10,914,514 B1 2/2021 Hunter et al.
(Continued)

FOREIGN PATENT DOCUMENTS

CN 102713478 A 10/2012

OTHER PUBLICATIONS

Henkel Sonderhoff System Solutions, Foam Sealing with FIPFG Technology, https://www.sonderhoff.com/en-us/solutions/process-technology/gasketing/ (last visited Aug. 16, 2023).

*Primary Examiner* — Daniel J Rohrhoff
(74) *Attorney, Agent, or Firm* — Price Heneveld LLP

(57) ABSTRACT

A vacuum insulated refrigerator includes a cabinet defining a refrigerator compartment. The cabinet includes a liner, a wrapper, and a trim breaker assembly coupled to the liner and the wrapper. The trim breaker assembly extends along a perimeter of the refrigerator compartment and includes a mullion region. At least one foam gasket is coupled to at least one surface of the trim breaker assembly and is routed from a first end of the mullion region, along a portion of the perimeter of the refrigerator compartment, and to a second end of the mullion region. The at least one surface of the trim breaker assembly is at least one of an outer surface, a side surface, and an inner surface. At least one engagement member is coupled to the trim breaker assembly to define a seal by compressing the at least one foam gasket therebetween.

15 Claims, 16 Drawing Sheets

(56) References Cited

U.S. PATENT DOCUMENTS

| | | | | |
|---|---|---|---|---|
| 11,340,008 | B1 * | 5/2022 | Hunter | F25D 23/066 |
| 11,479,021 | B2 | 10/2022 | Allard et al. | |
| 2016/0258671 | A1 | 9/2016 | Allard et al. | |
| 2019/0128591 | A1 | 5/2019 | Visin et al. | |
| 2020/0348072 | A1 | 11/2020 | Allard et al. | |
| 2021/0148628 | A1 | 5/2021 | Lottinville et al. | |
| 2021/0222944 | A1 * | 7/2021 | Harikrishnasamy | F25D 23/067 |
| 2022/0205711 | A1 * | 6/2022 | Harikrishnasamy | F25D 23/066 |
| 2022/0252333 | A1 * | 8/2022 | Awachat | F25D 23/085 |
| 2022/0282905 | A1 | 9/2022 | Hunter et al. | |

* cited by examiner

TRIM BREAKER INTERFACE FOR REDUCING AIR INFILTRATION IN A VACUUM INSULATED APPLIANCE

BACKGROUND OF THE DISCLOSURE

The present disclosure generally relates to a trim breaker interface formed by a foam gasket coupled to a trim breaker assembly, and more specifically, to a foam gasket coupled to a trim breaker assembly to define a seal for a vacuum insulated appliance and reduce air infiltration.

SUMMARY OF THE DISCLOSURE

According to an aspect of the present disclosure, a vacuum insulated refrigerator includes a cabinet defining a refrigerator compartment. The cabinet includes a liner, a wrapper, and a trim breaker assembly coupled to the liner and the wrapper. The trim breaker assembly extends along a perimeter of the refrigerator compartment. The trim breaker assembly includes a mullion region. At least one foam gasket is coupled to at least one surface of the trim breaker assembly. The at least one foam gasket is routed from a first end of the mullion region, along a portion of the perimeter of the refrigerator compartment, and to a second end of the mullion region. The at least one surface of the trim breaker assembly is at least one of an outer surface, a side surface, and an inner surface. At least one engagement member is configured to couple to the trim breaker assembly and define a seal by compressing the at least one foam gasket between the at least one engagement member and the trim breaker assembly.

According to another aspect of the present disclosure, a vacuum insulated appliance includes a structural wrapper defining a freezer compartment. A trim breaker assembly is coupled to the structural wrapper. An insulation cavity is defined between the structural wrapper and the trim breaker assembly. The trim breaker assembly defines a perimeter of the freezer compartment and includes a mullion region. At least one foam gasket is coupled to at least one surface of the trim breaker assembly. The at least one foam gasket is routed from a first end of the mullion region, along a portion of the perimeter of the freezer compartment, and to a second end of the mullion region. The at least one surface of the trim breaker assembly includes at least one of an outer surface, a side surface, and an inner surface. At least one engagement member is coupled to the trim breaker assembly and define a seal by compressing the at least one foam gasket between the at least one engagement member and the trim breaker assembly to reduce air infiltration into the freezer compartment.

According to yet another aspect of the present disclosure, a method for manufacturing a vacuum insulated structure includes providing a cabinet defining an insulation cavity and forming at least one compartment, the cabinet including a trim breaker assembly that extends along a perimeter of the at least one compartment, drawing an at least partial vacuum within the insulating cavity, applying at least one foam gasket to at least one surface of the trim breaker assembly along at least a portion of the perimeter of the at least one compartment, and coupling at least one engagement member with the trim breaker assembly to compress the at least one foam gasket therebetween and define a seal to reduce air infiltration between the at least one engagement member and the trim breaker assembly into the at least one compartment.

These and other features, advantages, and objects of the present disclosure will be further understood and appreciated by those skilled in the art by reference to the following specification, claims, and appended drawings.

Figure 1:
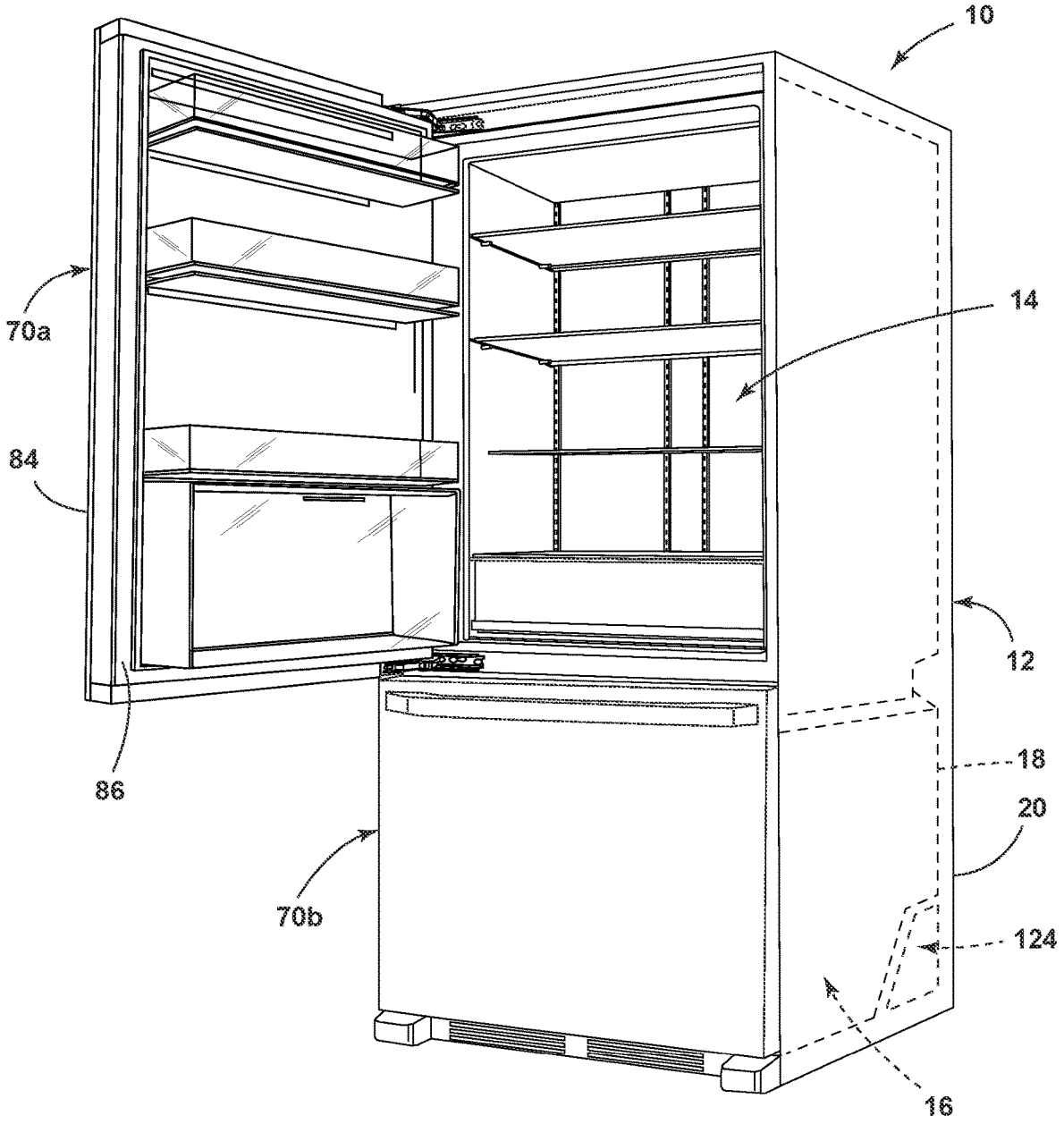
FIG. 1 is a front perspective of a refrigeration appliance, according to the present disclosure.
Figure 2:
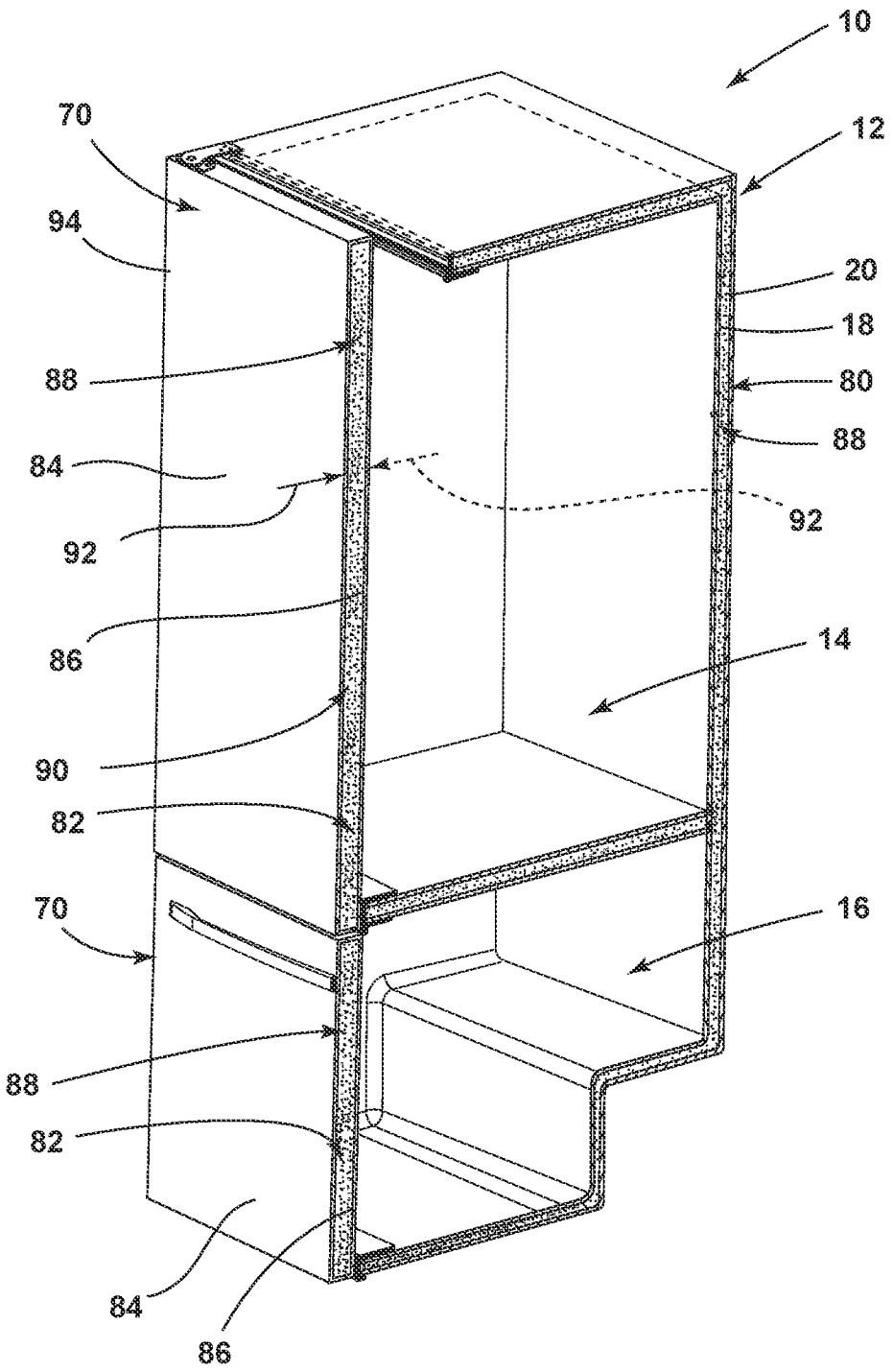
FIG. 2 is a cross-sectional view of a refrigeration appliance with a vacuum insulated cabinet and vacuum insulated doors, according to the present disclosure.
Figure 3:
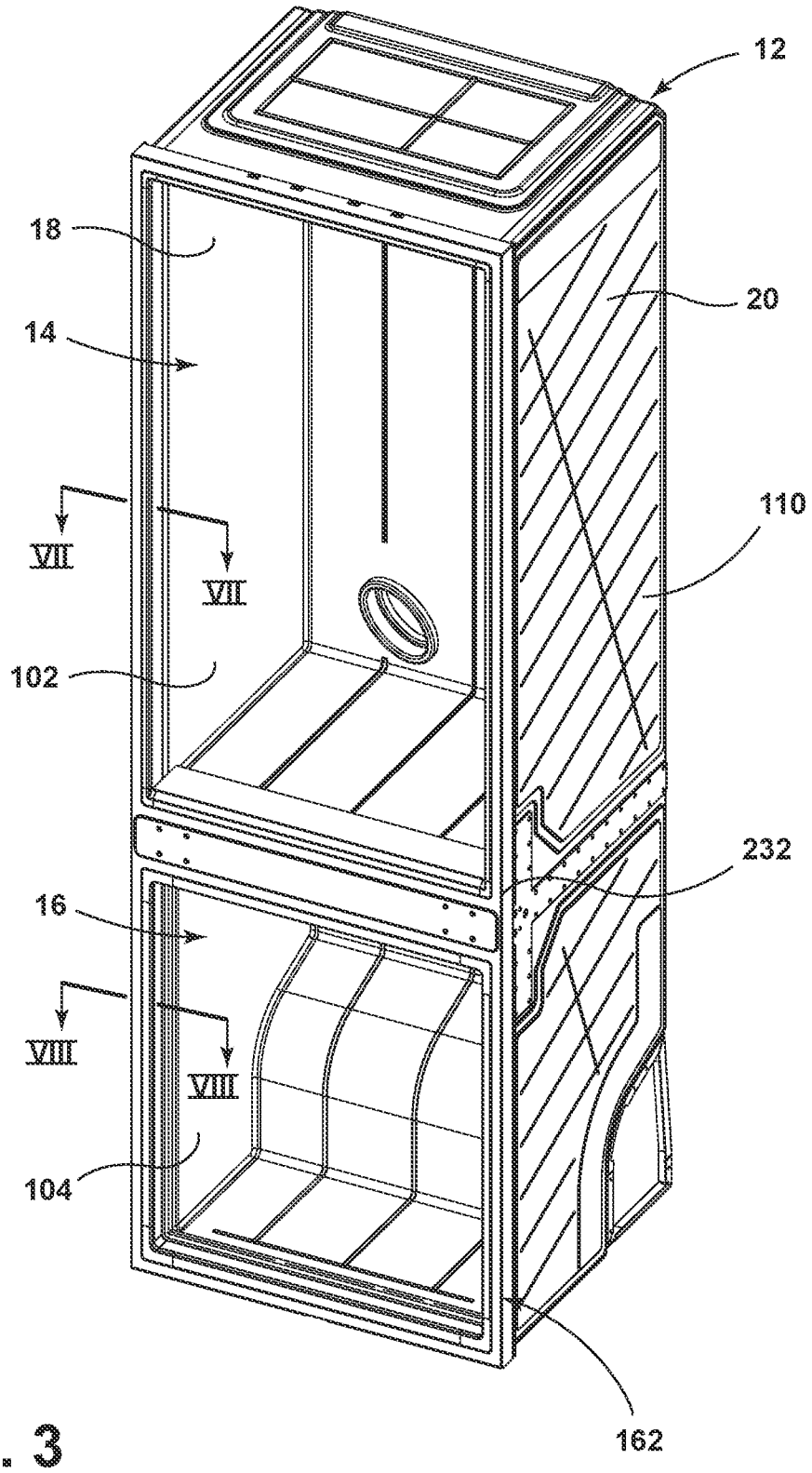
FIG. 3 is a front perspective of a cabinet for a refrigeration appliance with a trim breaker cover, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a foam gasket coupled to a trim breaker assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-12, reference numeral 10 generally designates a vacuum insulated structure including a cabinet 12 defining at least one compartment, often including a refrigerator compartment 14 and a freezer compartment 16. The cabinet 12 includes a liner 18, a wrapper 20, and a trim breaker assembly 22 coupled to the liner 18 and the wrapper 20. The trim breaker assembly 22 extends along a perimeter 24 of the refrigerator compartment 14 and a perimeter 26 of the freezer compartment 16, and the trim breaker assembly 22 includes a mullion region 28. At least one refrigerator compartment (RC) foam gasket 30, which may include RC foam gaskets 30*a*-30*c* that are collectively referred to herein as the RC foam gaskets 30, is coupled to at least one surface 32 of the trim breaker assembly 22. At least one freezer compartment (FC) foam gasket 34, which may include FC foam gaskets 34*a*-34*c* that are collectively referred to herein as the FC foam gaskets 34, is coupled to the at least one surface 32 of the trim breaker assembly 22. The RC foam gaskets 30 and FC foams gaskets 34 may also be referred to as the foam gaskets 30, 34.

The RC foam gasket 30 is routed from a first end 36 of the mullion region 28, along a portion 38 of the perimeter 24 of the refrigerator compartment 14, and to a second end 40 of the mullion region 28. The FC foam gasket 34 is routed from the first end 36 of the mullion region 28, along a portion 42 of the perimeter 26 of the freezer compartment 16, and to the second end 40 of the mullion region 28. The at least one surface 32 of the trim breaker assembly 22 is at least one of an outer surface 44, which may include a first outer surface 44*a* and a second outer surface 44*b*, a side surface 46, which may include a first side surface 46*a* and a second side surface 46*b*, and an inner surface 48, which may include a first inner surface 48*b* and a second inner surface 48*b*. The first surfaces 44*a*, 46*a*, 48*a* generally extend along the perimeter of the refrigerator compartment 14 and the second surfaces 44*b*, 46*b*, 48*b* generally extend along the perimeter of the freezer compartment 16.

At least one engagement member 50, which may include a plurality of engagement members 50, is configured to couple to the trim breaker assembly 22 to define at least one of a refrigerator compartment (RC) seal 52 by compressing the RC foam gasket 30. The RC seal 52 may include RC seals 52*a*-52*c*, which may be collectively referred to as the RC seals 52. Additionally, the at least one engagement member 50 is configured to couple to the trim breaker assembly 22 to define at least one freezer compartment (FC) seal 54 by compressing the FC foam gasket 34. The FC seal 54 may include FC seals 54*a*-54*c*, which may be collectively referred to as FC seals 54.

Referring still to FIGS. 1-4, the vacuum insulated appliance 10 is illustrated as a refrigeration appliance. The refrigeration appliance 10 is illustrated as a bottom-mount refrigerator having an upper compartment configured as the refrigerator compartment 14 and a lower compartment configured as the freezer compartment 16.

The cabinet 12 of the illustrated refrigeration appliance 10 includes a first insulated door 70*a* and a second insulated door 70*b*. The first insulated door 70*a* and the second insulated door 70*b*, which can collectively be referred to as insulated doors 70, can have substantially similar configurations, as discussed further herein. In this way, the refrigerator and freezer compartments 14, 16 defined by the cabinet 12 can be sealed with the insulated doors 70*a*, 70*b*, respectively. Moreover, in various configurations, the appliance 10 may include the cabinet 12 defining at least a first compartment and a second compartment sealed with insulated doors 70. The appliance 10 may be, for example, a bottom-mount French door refrigerator, a top-mount refrigerator, a side-by-side refrigerator, a 4-door French door refrigerator, and/or a 5-door French door refrigerator. Further, the present disclosure is not limited to refrigerators. The appliance 10 may be, for example, freezers, coolers, vacuum insulated structures, and other similar appliances and fixtures within household and commercial settings. Further, it is contemplated that the vacuum insulated appliance 10 disclosed herein may be for a variety of appliances, structures, panels, or assemblies for insulation purposes other than with an appliance.

The cabinet 12 of the appliance 10 is an insulated structure having an insulation cavity 80 defined between the liner 18 and the wrapper 20. Similarly, the insulated doors 70 are insulated structures having an insulation cavity 82 defined between a door wrapper 84 and a door liner 86. Each of the insulation cavities 80, 82 typically includes one or more insulation materials 88 disposed therein. It is generally contemplated that the insulation materials 88 may be glass-type materials, carbon-based powders, silicon oxide-based materials, silica-based materials, insulating gasses, and other standard insulation materials 88 known in the art.

The insulation materials 88 substantially fill the insulation cavity 80, forming a substantially continuous layer between the wrapper 20 and the liner 18. Similarly, the insulation materials 88 substantially fill the insulation cavity 82, forming a substantially continuous layer between the door wrapper 84 and the door liner 86. The insulation cavities 80, 82 are filled with the insulation materials 88 using load ports on the cabinet 12 and the insulated doors 70, respectively. The cabinet 12 and the insulated doors 70 each define an evacuation port for applying a vacuum or negative pressure to the insulation cavities 80, 82.

Referring still to FIGS. 1-4, an at least partial vacuum 90 is defined within the insulation cavities 80, 82. The at least partial vacuum 90 defines a pressure differential 92 between an exterior 94 of the cabinet 12 and the insulation cavity 80. The pressure differential 92 serves to define the inward compressive force that is exerted on both the wrapper 20 and the liner 18 and tends to bias the wrapper 20 and the liner 18 toward the insulation cavity 80. The pressure differential 92 and the inward compressive force are also exerted on both the door wrapper 84 and the door liner 86 of the insulated doors 70 and tend to bias the door wrapper 84 and the door liner 86 towards the insulation cavity 82 in a similar manner.

The wrapper 20, the door wrapper 84, the liner 18, and the door liner 86 are made from a material at least partially resistant to bending, deformation, or otherwise being formed in response to an inward compressive force. These materials for the wrapper 20, the door wrapper 84, the liner 18, and the door liner 86 include, but are not limited to, metals, polymers, metal alloys, combinations thereof, and/or other similar substantially rigid materials that can be used for vacuum insulated appliances 10 and structures.

The liner 18 may include a first portion 102, which can also be referred to as a refrigerator portion 102, to define the refrigerator compartment 14, and a second portion 104, which can also be referred to as a freezer portion 104, to define the freezer compartment 16. The refrigerator portion 102 of the liner 18 and the freezer portion 104 of the liner 18 may be separate components defining a mullion gap 106 in the insulation cavity 80 between the portions 102, 104 when coupled together. The mullion gap 106 may be filled with the insulation materials 88 and be placed under the at least partial vacuum 90. The refrigerator portion 102 and the freezer portion 104 of the liner 18 may be biased toward the mullion gap 106 in the insulation cavity 80, in a similar manner to that discussed with reference to the wrapper 20 and the liner 18 generally.

In various implementations, the refrigerator portion 102 and the freezer portion 104 of the liner 18 may be coupled together in the mullion gap 106 separate from the trim breaker 22. The refrigerator portion 102 and the freezer portion 104 may still define the mullion gap 106 when coupled together. While the liner 18 is shown as having two separate portions 102, 104, the liner 18 may be a single portion or structure defining the refrigerator and freezer compartments 14, 16. The liner 18 may also be a single structure defining the refrigerator compartment 14 or the freezer compartment 16. The liner 18 can generally have a similar shape as the wrapper 20 to fit within the wrapper 20 and form the cabinet 12.

Figure 4:
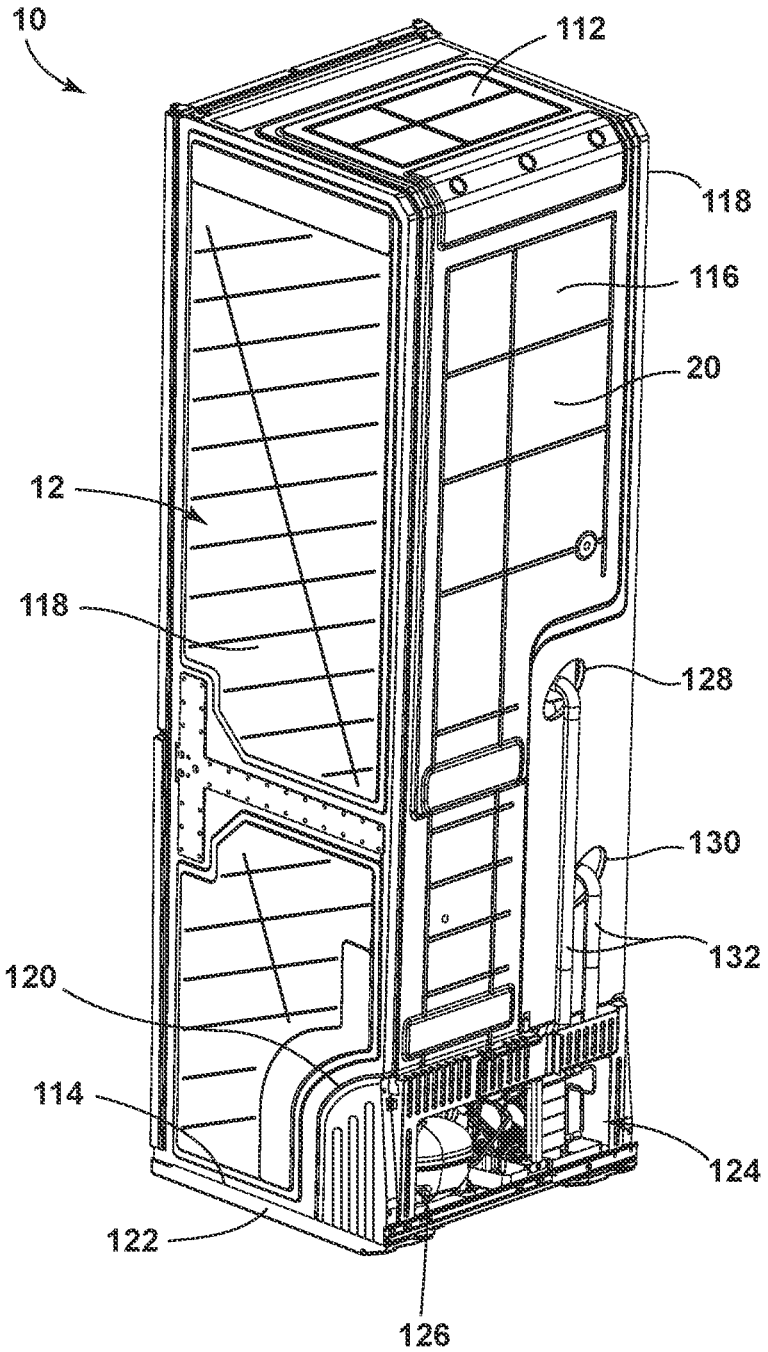
FIG. 4 is a side perspective view of a refrigeration appliance, according to the present disclosure.
Figure 5:
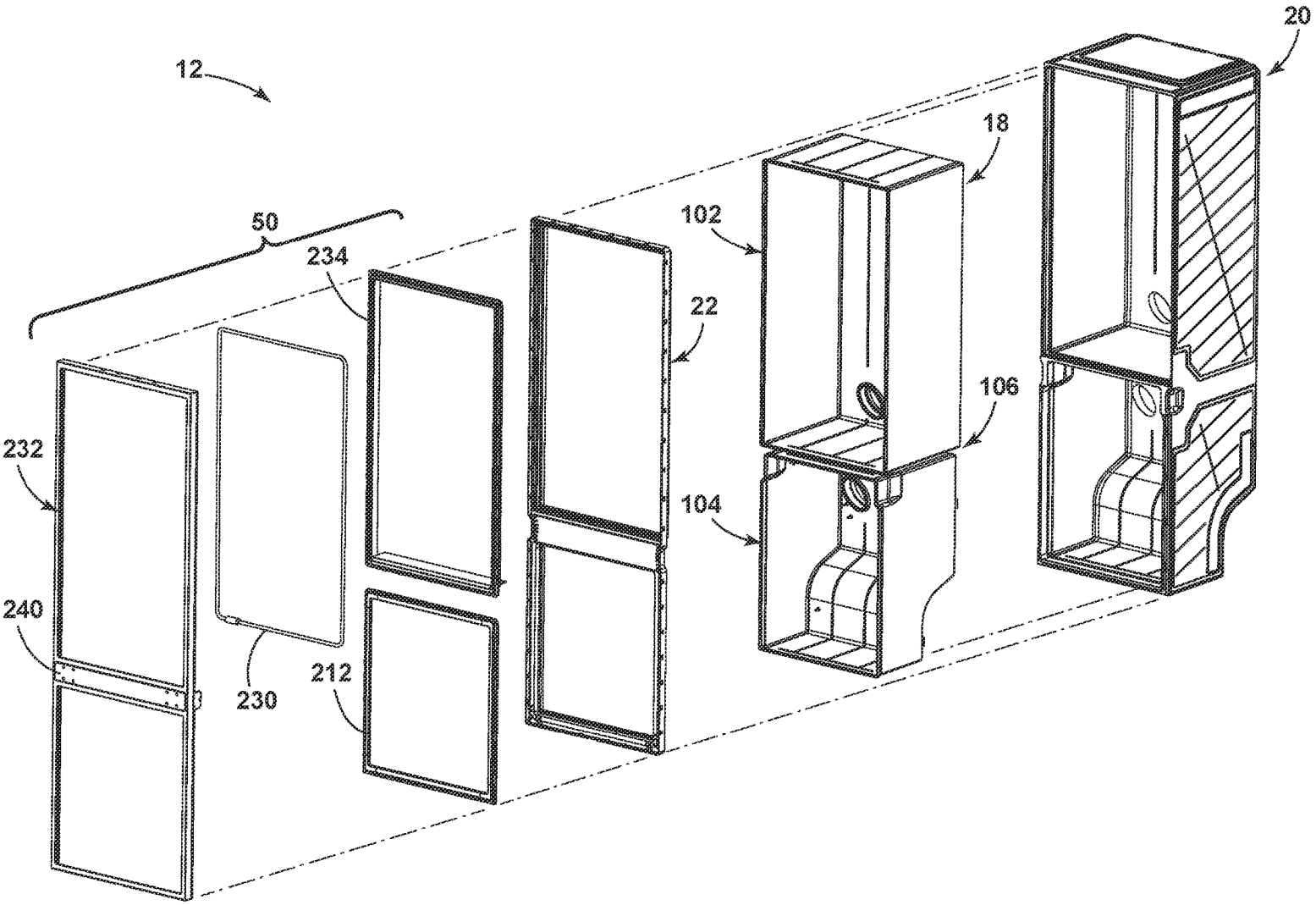
FIG. 5 is an exploded side perspective view of a cabinet for a refrigeration appliance with a wrapper, a liner, a trim breaker assembly, and engagement members to engage the trim breaker assembly, according to the present disclosure.

Referring still to FIG. 4, as well as FIG. 5, the wrapper 20 has a plurality of walls 110, which may include a top wall 112, a bottom wall 114, a rear wall 116, a pair of side walls 118, and a curved wall 120. The bottom wall 114 of the wrapper 20 may be coupled to a base 122. The curved wall 120 of the wrapper 20 and the base 122 at least partially define a mechanical compartment 124. The wrapper 20 and the liner 18 may collectively be referred to as a structural wrapper defining the insulation cavity 80. Various appliance components 126 can be positioned on the base 122 within the mechanical compartment 124 below the rear wall 116 and proximate to the curved wall 120 of the wrapper 20. The appliance components 126 positioned within the mechanical compartment 124 may include components of a refrigerant system, which may include a compressor, a condenser, and/or portions of an evaporator assembly. The appliance components 126 may also include a controller, electronics, or other components for operation of the appliance 10.

The wrapper 20 and the liner 18 may define a first passthrough 128 and a second passthrough 130 to provide a passage for service connections 132. The wrapper 20 and the liner 18 each define apertures that align with one another to form the first and second passthroughs 128, 130. The service connections 132 may be electrical, fluid, refrigerant system, and/or other appliance connections between the refrigerator and freezer compartments 14, 16 and outside the cabinet 12. For example, the service connections 132 may include a suction tube, a drain tube, and a wiring harness.

Figure 6:
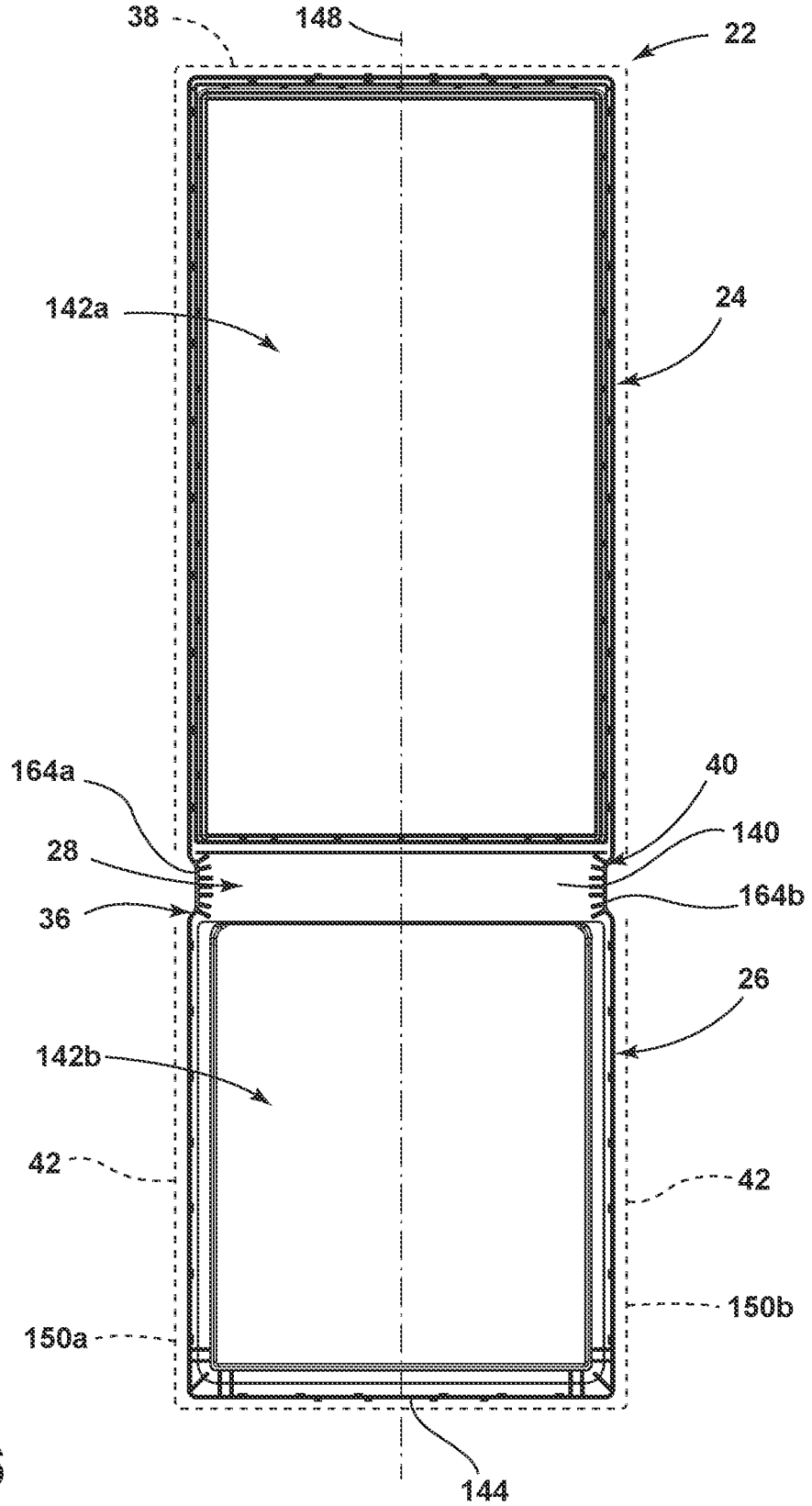
FIG. 6 is a front elevational view of the trim breaker of FIG. 5, according to the present disclosure.

Referring still to FIG. 5, as well as FIG. 6, the trim breaker assembly 22 generally couples the wrapper 20 to the liner 18 to form the cabinet 12. It is contemplated that the trim breaker assembly 22 may be coupled to outer edges 136 of the wrapper 20 and/or the liner 18. The trim breaker assembly 22 has a generally rectangular shape, however, it is contemplated that other geometric shapes known in the art may be used. In this way, the trim breaker assembly 22 may not substantially interfere with access to the refrigerator and freezer compartments 14, 16 defined by the cabinet 12. At least one channel 138 may be defined along a perimeter of the trim breaker assembly 22. The channel 138 may be configured to receive the outer edges 136 of the wrapper 20 and/or the liner 18. It is also contemplated that the trim breaker assembly 22 may define a wrapper channel 138*a* to accommodate the wrapper 20 and a liner channel 138*b* to accommodate the liner 18.

It is also contemplated that the trim breaker assembly 22 may define a first liner channel 138*b* along the perimeter 24 of the refrigerator compartment 14 and a second liner channel 138*b* along the perimeter 26 of the freezer compartment 16 for the refrigerator portion 102 and the freezer portion 104 of the liner 18, respectively. The channels 138 defined by the trim breaker assembly 22 may extend along the perimeter of the trim breaker assembly 22, as well as along a cross member 140 of the trim breaker assembly 22. The channels 138 may be filled with an adhesive, such as, for example, an epoxy. The adhesive is configured to couple the wrapper 20 and/or the liner 18 with the trim breaker assembly 22 and seal the insulation cavity 80.

The trim breaker assembly 22 includes the cross member 140 and defines apertures 142*a*, 142*b* corresponding to the refrigerator and freezer compartments 14, 16 of the appliance 10. The cross member 140 defines the mullion region 28 between the refrigerator and freezer compartments 14, 16. In the illustrated example, the trim breaker assembly 22 defines the perimeter 24 of the refrigerator compartment 14 around the upper aperture 142*a* and defines the perimeter 26 of the freezer compartment 16 around the lower aperture 142*b*. In this way, the perimeters 24, 26 define openings into the compartments 14, 16, respectively. The trim breaker assembly 22 may include a lower gap 144 to allow for a heat loop 146 to be routed from the mechanical compartment 124 to couple to the trim breaker assembly 22. The lower gap 144 may be proximate the lower aperture 142*b* and centered on a centerline 148 of the trim breaker assembly 22. The lower gap 144 may define a break in the surface 32 of the trim breaker assembly 22.

Referring still to FIG. 6, the RC foam gasket 30 and the FC foam gasket 34 are generally each coupled to the surface 32 of the trim breaker assembly 22. The RC foam gasket 30 is coupled to the surface 32 of the trim breaker assembly 22 along the portion 38 of the perimeter 24 of the refrigerator compartment 14. The RC foam gasket 30 may be routed from the first end 36 of the mullion region 28, along the portion 38 of the perimeter 24, and to the second end 40 of the mullion region 28, extending around at least a substantial portion of the refrigerator compartment 14. The RC foam gasket 30 may be continuous or may be divided into segments along the portion 38 of the perimeter 24. In some implementations, the RC foam gasket 30 may be routed along the full perimeter 24 of the refrigerator compartment 14. In such examples, the RC foam gasket 30 also extends along the mullion region 28 between the first end 36 and the second end 40.

The FC foam gasket 34 is coupled to the surface 32 of the trim breaker assembly 22, which may be the same surface 32 or a different surface 32 of the trim breaker assembly 22 compared to the RC foam gasket 30. The FC foam gasket 34 extends along the portion 42 of the perimeter 26 of the freezer compartment 16. The FC foam gasket 34 may be routed from the first end 36 of the mullion region 28, along the portion 42 of the perimeter 26, and to the second end 40 of the mullion region 28, extending around at least a substantial portion of the freezer compartment #16. The FC foam gasket 34 may be divided into a first segment 150*a* and a second segment 150*b*, but is not limited to such configurations and may be split into a plurality of segments or may be continuous. The first segment 150*a* of the FC foam gasket 34 may be routed from the first end 36 of the mullion region 28 to the lower gap 144 and the second segment 150*b* of the FC foam gasket 34 may be routed from the lower gap 144 to the second end 40 of the mullion region 28. In some implementations, the FC foam gasket 32 may be routed along the full perimeter 26 of the freezer compartment 16. In such examples, the FC foam gasket 32 also extends along the mullion region 28 between the first end 36 and the second end 40.

In some implementations, the RC foam gasket 30 and the FC foam gasket 34 may be coupled to and collectively routed along a perimeter 162 of cabinet 12 defined by the trim breaker assembly 22. The RC foam gasket 30 may be routed from the first end 36 of the mullion region 28 and along the portion 38 of the perimeter 24 of the refrigerator compartment 14 to the second end 40 of the mullion region 28. The FC foam gasket 34 may extend from the second end 40 of the mullion region proximate to the RC foam gasket 30, along the portion 42 of the perimeter 26 of the freezer compartment 16, and to the first end 36 of the mullion region 28 proximate to the RC foam gasket 30.

There may be gaps in the foam gaskets 30, 34 based on the configuration of the trim breaker assembly 22, including gaps 144 or recessed portions 164*a*, 164*b* located on the surface 32 of the trim breaker assembly 22, such as the lower gap 144. For example, the trim breaker assembly 22 may include a first recessed portion 164*a* on the first end 36 of the cross member 140 and a second recessed portion 164*b* on the second end 40 of the cross member 140. The foam gaskets 30, 34 may include gaps at the first recessed portion 164*a* and the second recessed portion 164*b* or gaps may be defined between the foam gaskets 30, 34 at the recessed portions 164*a*, 164*b*. The foam gaskets 30, 34 may be continuous about the perimeter 162 of the cabinet 12. The surface 32 of the trim breaker assembly 22 may be along the perimeter 162 of the trim breaker assembly 22 allowing for the foam gaskets 30, 34 to be coupled to the full perimeter 162 of the cabinet 12. The foam gaskets 30, 34 may also be continuous around the perimeter of the trim breaker assembly 22 by being laid in various gaps 144 or recessed regions 164*a*, 164*b* present on the trim breaker assembly 22.

Referring still to FIG. 6, and now also FIGS. 7A-10C, the trim breaker assembly 22 may include multiple cross-sectional profiles at different locations, including a first cross-sectional profile 180 along the portion 38 of the perimeter 24 of the refrigerator compartment 14 and a second cross-sectional profile 182 along the portion 42 of the perimeter 26 of the freezer compartment 16. The cross member 140 may be the first cross-sectional profile 180, the second cross-sectional profile 182, and/or another, third cross-sectional profile. The first cross-sectional profile 180 includes the outer surface 44*a*, the side surface 46*a*, and the inner surface 48*a*, and the second cross-sectional profile 182 includes the outer surface 44*b*, the side surface 46*b*, and the inner surface 48*b*.

Referring to FIGS. 7A-7C and 9A-9C, the first cross-sectional profile 180 of the trim breaker assembly 22 includes an outside wall 190 that includes the side surface 46*a*. A wrapper channel wall 192 is coupled or connected to the outside wall 190. The wrapper channel wall 192 extends away from and then parallel to the outside wall 190 to define the wrapper channel 138*a* therebetween. The outside wall 190 also includes the outer surface 44*a* defined on a distal end 194 of the outside wall 190 that extends away from the wrapper channel 138*a*. The side surface 46*a* is generally adjacent to and perpendicular to the outer surface 44*a*.

An inner wall 196 is coupled or connected to the wrapper channel wall 192 and extends to a liner channel wall 198 that defines the liner channel 138*b*. The wrapper channel 138*a* may be offset from the liner channel 138*b*. The inner wall 196 includes a cavity surface facing the insulation cavity 80 and the inner surface 48*a* opposing the insulation cavity 80, oriented toward an interior of the compartment 14. The inner surface 48*a* is not limited to the inner wall 196 and may also extend along the wrapper channel wall 192 opposing the wrapper channel 138*a* or the liner channel wall 198 opposing the liner channel 138*b*.

Figure 7A:
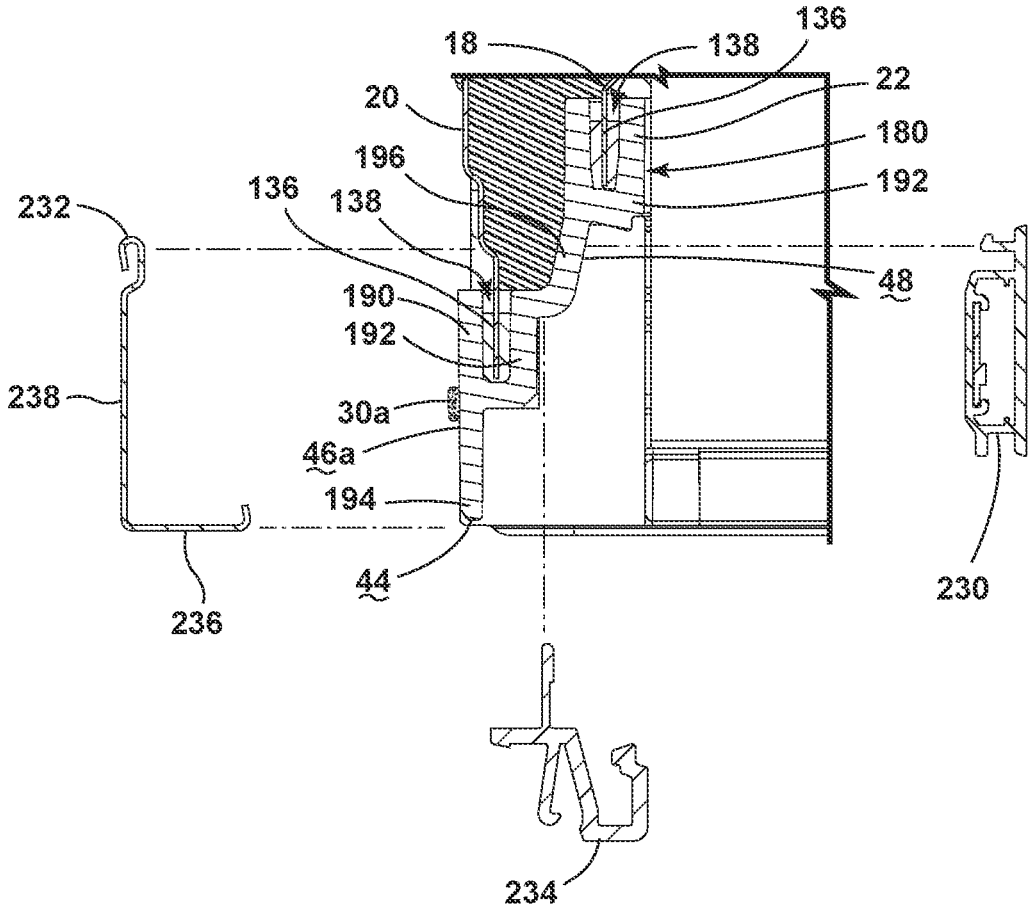
FIG. 7A is a partially exploded and partial cross-sectional view of the cabinet of FIG. 3 taken along lines VII-VII, illustrating a trim breaker assembly, engagement members, and a foam gasket on a side surface of the trim breaker assembly, according to the present disclosure.
Figure 7B:
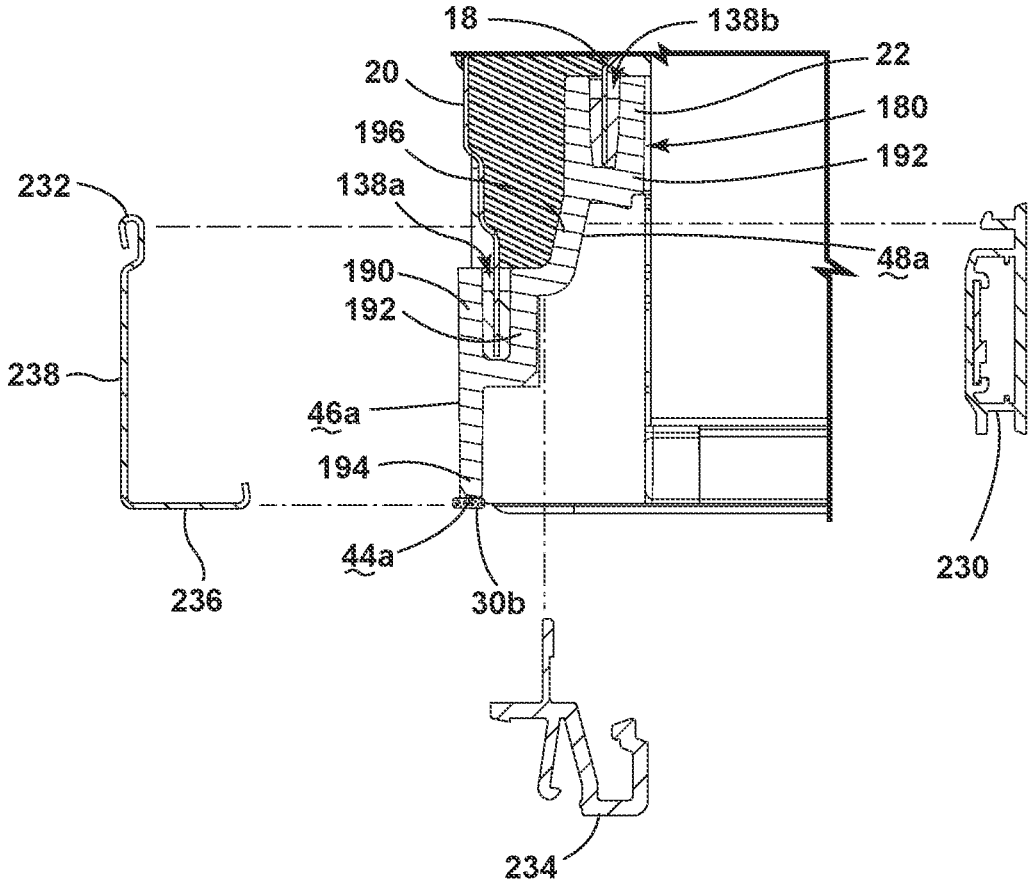
FIG. 7B is a partially exploded and partial cross-sectional view of a cabinet of a refrigeration appliance, illustrating a trim breaker assembly, engagement members, and a foam gasket on an outer surface of the trim breaker assembly, according to the present disclosure.
Figure 7C:
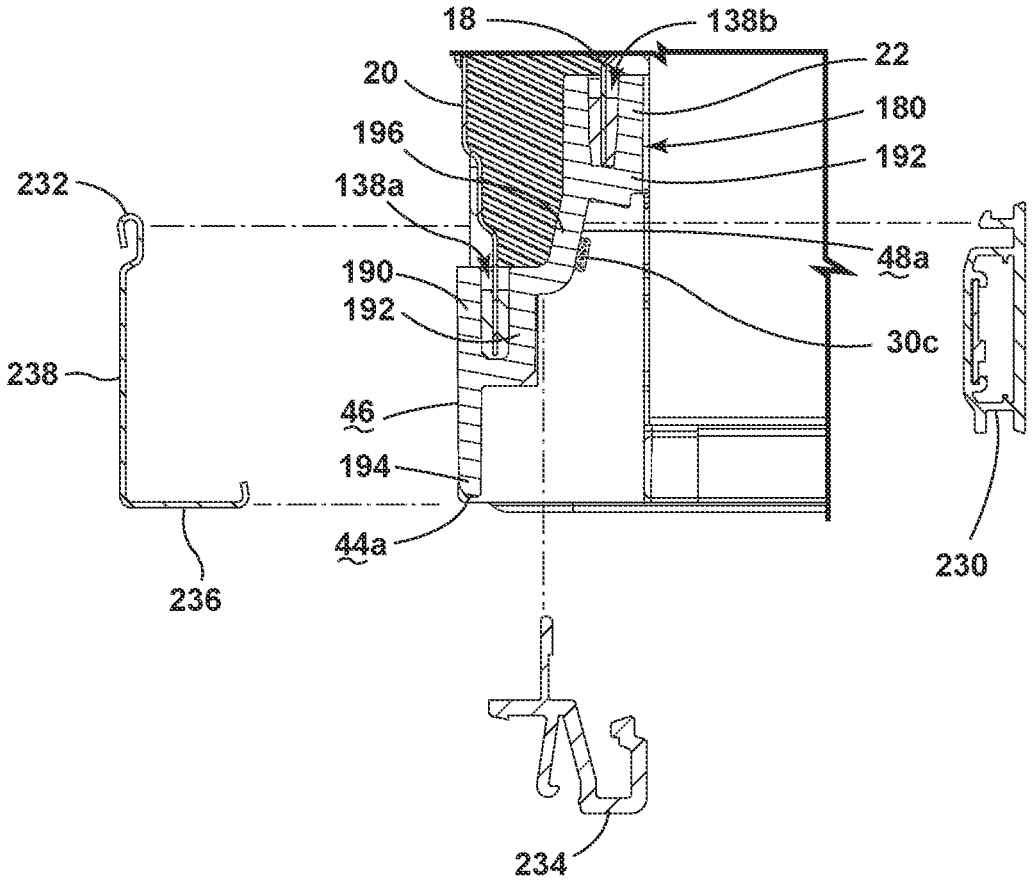
FIG. 7C is a partially exploded and partial cross-sectional view of a cabinet of a refrigeration appliance, illustrating a trim breaker assembly, engagement members, and a foam gasket on an inner surface of the trim breaker assembly, according to the present disclosure.
Figure 9A:
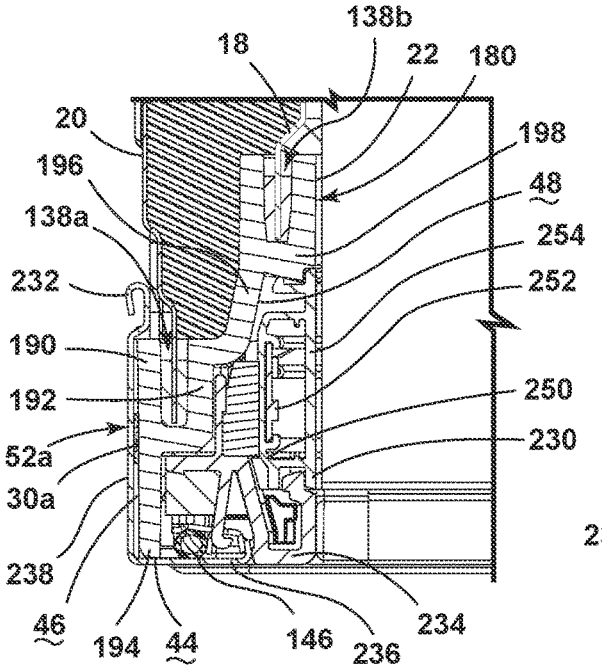
FIG. 9A is a partial cross-sectional view of the cabinet of FIG. 3 taken along VII-VII, illustrating a trim breaker assembly coupled to engagement members compressing a foam gasket on a side surface of the trim breaker assembly, according to the present disclosure.
Figure 9B:
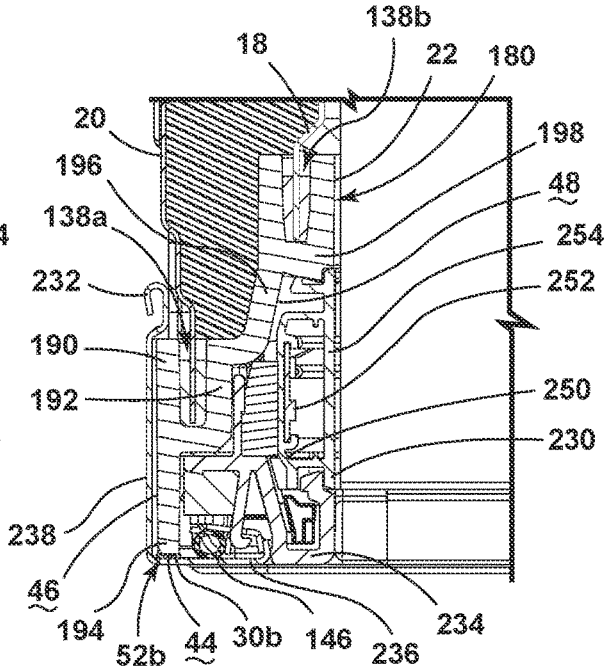
FIG. 9B is a partial cross-sectional view of a cabinet of a refrigeration appliance, illustrating a trim breaker assembly coupled to engagement members compressing a foam gasket on an outer surface of the trim breaker assembly, according to the present disclosure.
Figure 9C:
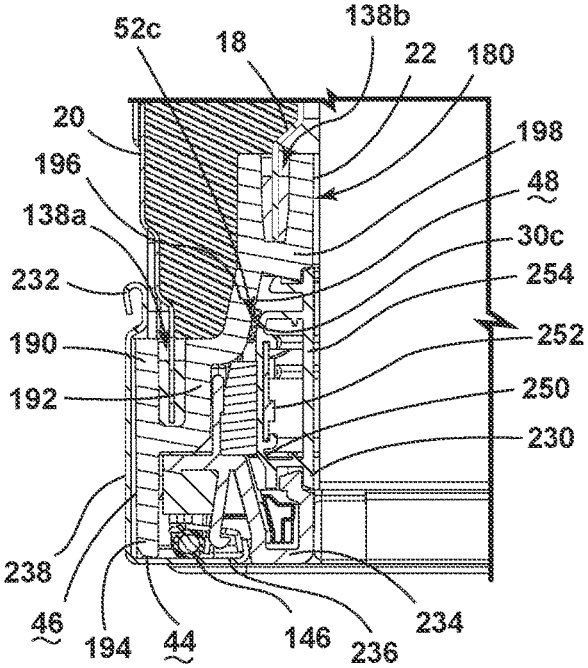
FIG. 9C is a partial cross-sectional view of a cabinet of a refrigeration appliance, illustrating a trim breaker assembly coupled to engagement members compressing a foam gasket on an inner surface of the trim breaker assembly, according to the present disclosure.

The RC foam gasket 30 is coupled to at least one of the outer surface 44*a*, the outer surface 46*b*, and the inner surface 48*a* (i.e., at least one of the surfaces 32) of the first cross-sectional profile 182 of the trim breaker assembly 22. The RC foam gasket 30*a* may be coupled to the side surface 46*a* of the trim breaker assembly 22, as shown in FIGS. 7A and 9A. The RC foam gasket 30*b* may be coupled to the outer surface 44*a* of the trim breaker assembly 22, as shown in FIGS. 7B and 9B. The RC foam gasket 30*c* may be coupled to the inner surface 48*a*, as shown in FIGS. 7C and 9C. In some variations, the trim breaker assembly 22 may include two RC foam gaskets 30 coupled to the respective surfaces 32. For example, the first RC foam gasket 30*a* may be coupled to the side surface 46*a* and the third RC foam gasket 30*c* may be coupled to the inner surface 48*a*. The trim breaker assembly 22 may also include the first RC foam gasket 30*a*, the second RC foam gasket 30*b*, and the third RC foam gasket 30*c* coupled to the respective surfaces 32.

Referring to FIGS. 8A-8C and 10A-10C, the second cross-sectional profile 182 includes an outside wall 200 that defines the side surface 46*b*. A wrapper channel wall 192 is coupled or connected to the outside wall 200. The wrapper channel wall 202 extends away from and then parallel to the outside wall 200 to define the wrapper channel 138*a* therebetween. The outside wall 200 also includes the outer surface 44*b* defined on a distal end of 204 of the outside wall 200 that extends away from the wrapper channel 138*a*. The side surface 46*b* is generally adjacent to and perpendicular to the outer surface 44*b*.

An inner wall 206 is coupled to the wrapper channel wall 202 and extends and connects to a liner channel wall 208 that defines the liner channel 138*b*. The wrapper channel 138*a* may be offset from the liner channel 138*b*. The inner wall 206, the outside wall 200, and the wrapper channel wall 202, define a receiving recess 210 to couple to a freezer compartment (FC) trim breaker adapter 212. The inner wall 206 and the wrapper channel wall 202 may define the inner surface 48*b* within the receiving recess 210. The inner surface 48*b* is not limited to the surface defined by the inner wall 206 and the wrapper channel wall 202. The inner surface 48*b* may extend along the inner wall 206 within the receiving recess 210 or along the inner wall 206 opposing the insulation cavity 80.

Figure 8A:
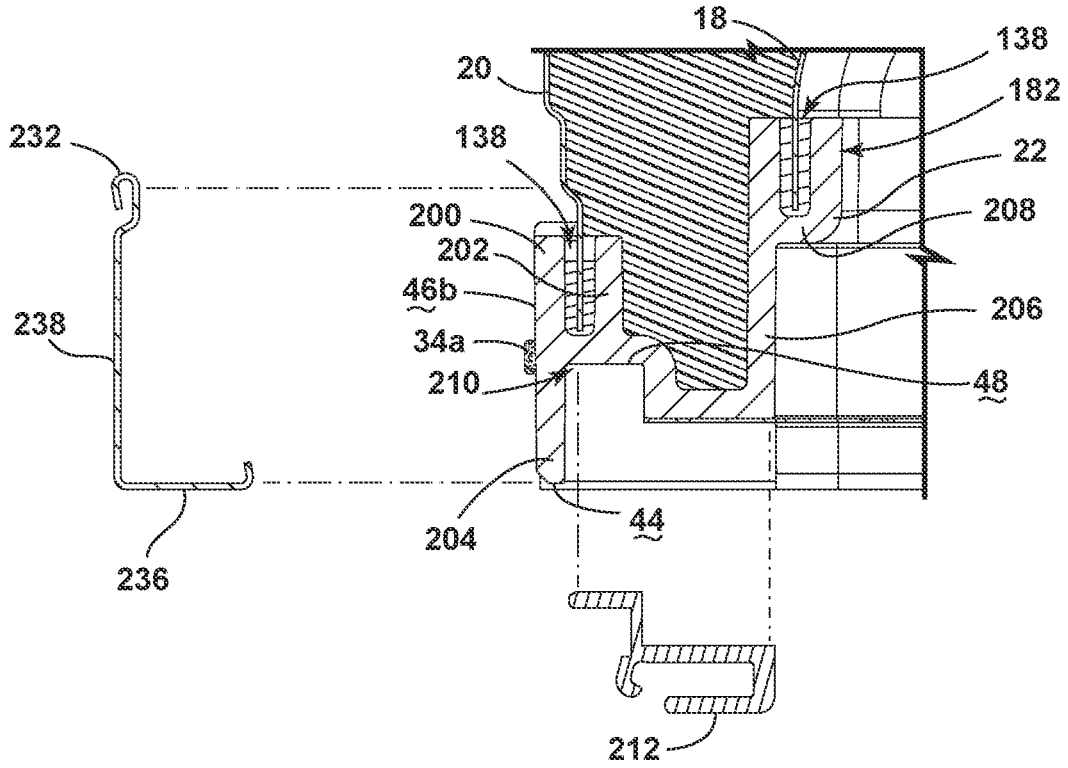
FIG. 8A a partially exploded and partial cross-sectional view of the cabinet of FIG. 3 taken along lines VIII-VIII, illustrating a trim breaker assembly, engagement members, and a foam gasket on a side surface of the trim breaker assembly, according to the present disclosure.
Figure 8B:
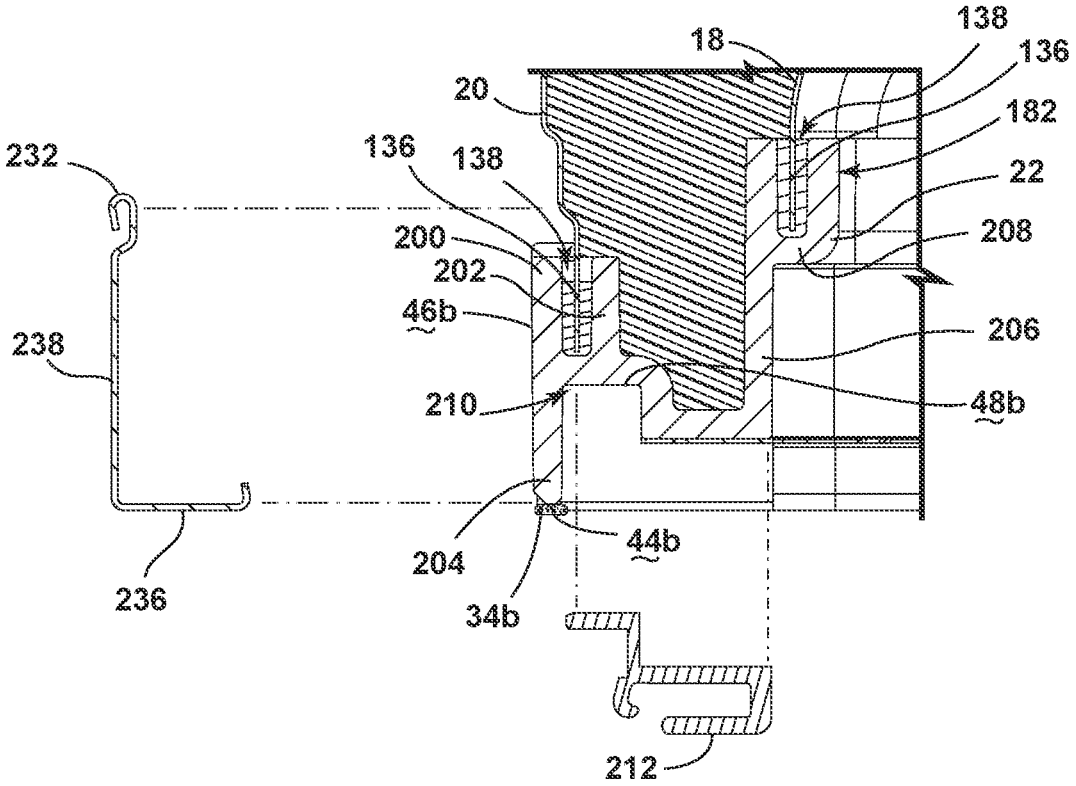
FIG. 8B is a partially exploded and partial cross-sectional view of a cabinet of a refrigeration appliance, illustrating a trim breaker assembly, engagement members, and a foam gasket on an outer surface of the trim breaker assembly, according to the present disclosure.
Figure 8C:
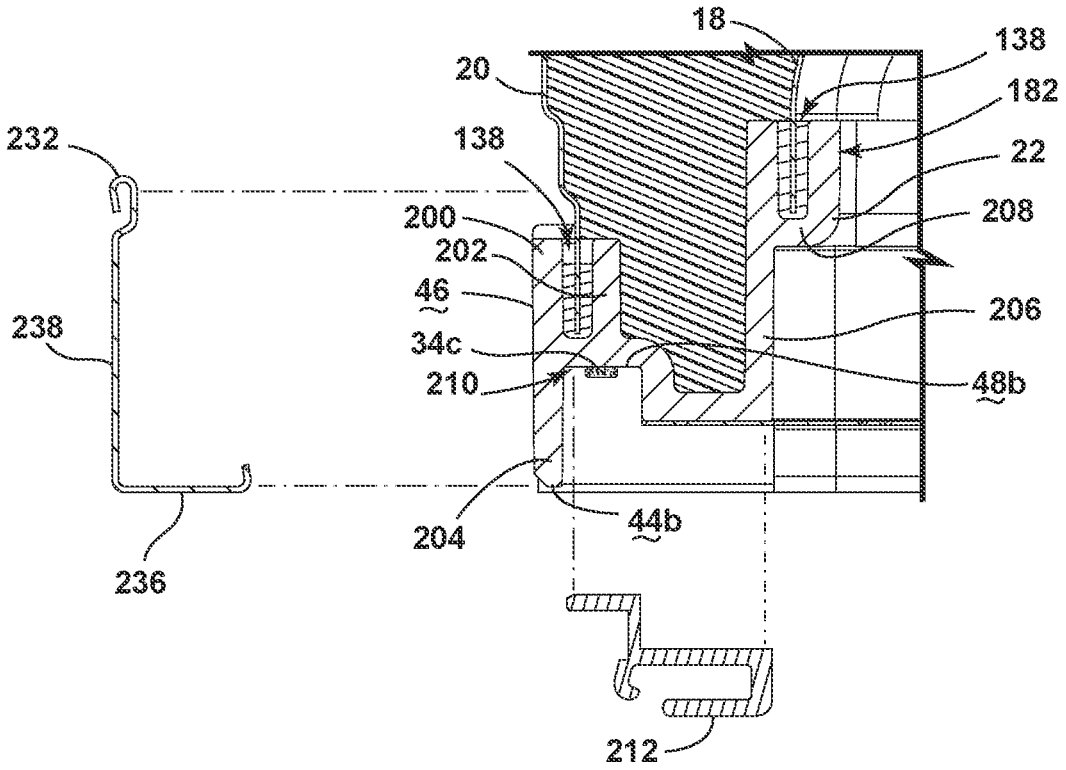
FIG. 8C is a partially exploded and partial cross-sectional view of a cabinet of a refrigeration appliance, illustrating a trim breaker assembly, engagement members, and a foam gasket on an inner surface of the trim breaker assembly, according to the present disclosure.
Figure 10A:
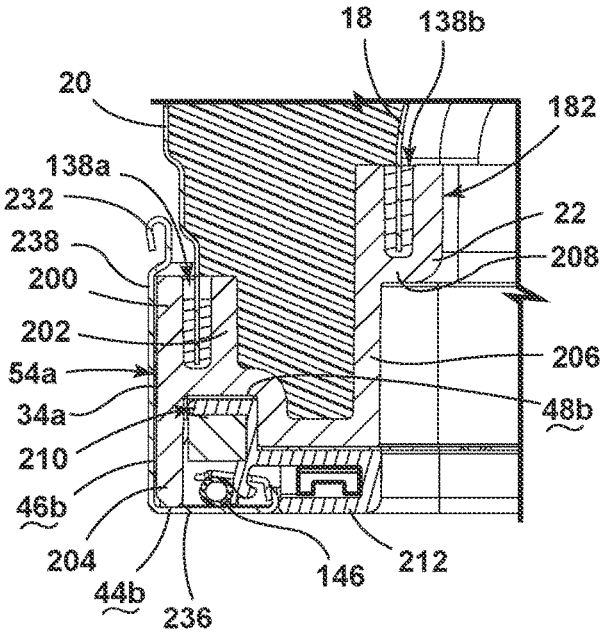
FIG. 10A is a partial cross-sectional view of the cabinet of FIG. 3 taken along lines VIII-VIII, illustrating a trim breaker assembly coupled to engagement members compressing a foam gasket on a side surface of the trim breaker assembly, according to the present disclosure.
Figure 10B:
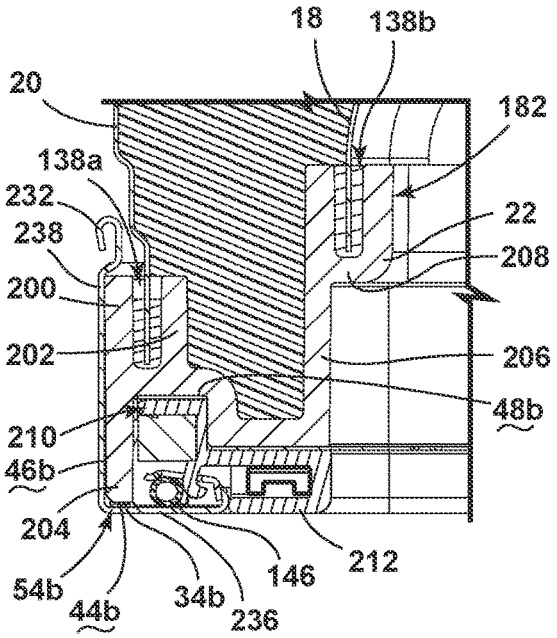
FIG. 10B is a partial cross-sectional view of a cabinet of a refrigeration appliance, illustrating a trim breaker assembly coupled to engagement members compressing a foam gasket on an outer surface of the trim breaker assembly, according to the present disclosure.
Figure 10C:
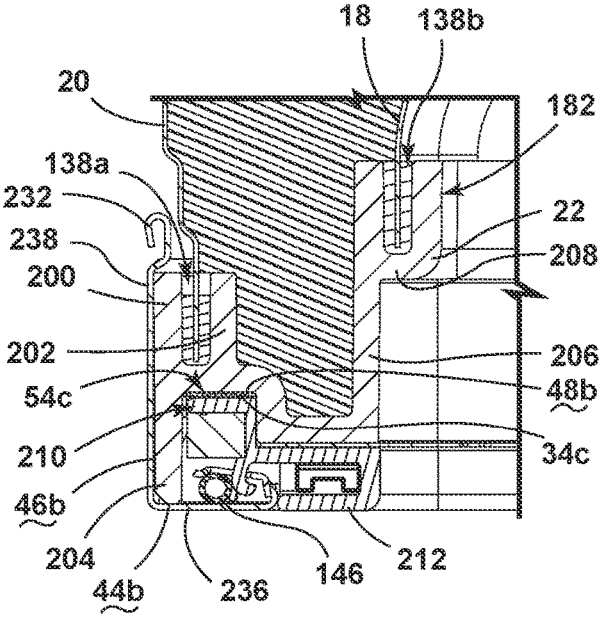
FIG. 10C is a partial cross-sectional view of a cabinet of a refrigeration appliance, illustrating a trim breaker assembly coupled to engagement members compressing a foam gasket on an inner surface of the trim breaker assembly, according to the present disclosure.

The FC foam gasket 34 is coupled to and extends along at least one of the outer surface 44*b*, the side surface 46*b*, and the inner surface 48*b* (i.e., at least one of the surfaces 32). The FC foam gasket 34*a* may be coupled to the side surface 46*b* of the trim breaker assembly 22, as shown in FIGS. 8A and 10A. The FC foam gasket 34*b* may be coupled to the outer surface 44*a* of the trim breaker assembly 22, as shown in FIGS. 8B and 10B. The FC foam gasket 34*c* may be coupled to the inner surface 48*a*, as shown in FIGS. 8C and 10C. In some variations, the trim breaker assembly 22 may include two FC foam gaskets 34 coupled to the respective surfaces 32. For example, the first FC foam gasket 34*a* may be coupled to the side surface 46*a* and the third FC foam gasket 34*c* may be coupled to the inner surface 48*a*. The trim breaker assembly 22 may also include the first FC foam gasket 34*a*, the second FC foam gasket 34*b*, and the third FC foam gasket 34*c* coupled to the respective surfaces 32.

Referring again to FIGS. 6-10C, the side surface 46 may extend between the first cross-sectional profile 180 and the second cross-sectional profile 182 allowing the foam gaskets 30, 34 to be coupled and extend therebetween. The first and second ends 36, 40 of the cross member 140 may be flush with the outside walls 190, 200 creating the continuous side surface 46 extending along the perimeter 162 of the cabinet 12. In some implementations, the side surface 46 may extend along the recessed portions 164*a*, 164*b* on the first and second ends 36, 40 of the cross member 140. The foam gaskets 30, 34 may be coupled to the side surface through the recessed portions 164*a*, 164*b*. However, the side surface 46 is not limited to extending along the first and second ends 36, 40 of the cross member 140 and may extend along the first cross-sectional profile 180 and/or second cross-sectional profile 182 of the trim breaker assembly 22 with gaps at the mullion region 28.

The outer surface 44 may extend between the first cross-sectional profile 180 and the second cross-sectional profile 182 through the mullion region 28 of the trim breaker assembly 22. The cross member 140 may include raised portions that extend between the distal ends 194, 204 of the outside walls 190, 200. The outer surface 44 may extend across the raised portions allowing the foam gaskets 30, 34 to extend between the first and second cross-sectional profiles 180, 182. In other implementations, the distal the distal ends 194, 204 of the outside walls 190, 200 may be flush or substantially flush with the cross member 140 thereby allowing the outer surface 44 to extend across the mullion region 28.

The inner surfaces 48*a*, 48*b* may extend around the perimeters 24, 26 of the compartments 14, 16. The inner surface 48*a*, 48*b* may create continuous surfaces along the first and second cross-sectional profiles 180, 182. The inner surfaces 48*a*, 48*b* may extend between the first cross-sectional profile 180 and the second cross-sectional profile 182 through the mullion region 28 of the trim breaker assembly 22. For example, the cross member 140 may define a groove or a raised portion to connect the inner surfaces 48*a*, 48*b*. In some implementations, the inner surfaces 48*a*, 48*b* may be flush or substantially flush with the cross member 140, thereby allowing the inner surface 48 to extend across the mullion region 28.

In some implementations, the first cross-sectional profile 180 and the second cross-sectional profile 182 may be the same profile around each of the compartments 14, 16. The first cross-sectional profile 180 and second cross-sectional profile 182 are not limited to the configurations described and may be configured to include at least one of the surfaces 32 to allow the at least one of the foam gaskets 30, 34 to couple thereto.

Referring to FIG. 5 and FIGS. 7A-10C, the engagement members 50 are configured to couple to the trim breaker assembly 22 and compress at least one of the RC foam gasket 30 and the FC foam gasket 34. The engagement member 50 may engage the trim breaker assembly 22 and compress both the RC foam gaskets 30 and the FC foam gaskets 34. The compressed RC foam gasket 30 and FC foam gasket 34 define the RC seal 52 and the FC seal 54, respectively, between the trim breaker assembly 22 and the engagement member 50. In various aspects, the engagement member 50 may compress the RC foam gasket 30 along the full portion 38 of the perimeter 24 of the refrigerator compartment 14. The engagement member 50 may also compress the FC foam gasket 34 along the full portion 42 of the perimeter 26 of the freezer compartment 16. The engagement members 50 generally include an engagement surface 228 to engage or compress the foam gaskets 30, 34.

The engagement member 50 may compress portions of the foam gaskets 30, 34 to form the seal around the compartments 14, 16 or the cabinet 12. The engagement member 50 may compress a portion of the RC foam gasket 30 along the portion 38 of the perimeter 24 of the refrigerator compartment 14. The engagement member may also compress a portion of the FC foam gasket 34 along the portion 42 of the perimeter 26 of the freezer compartment 16. For example, the FC foam gasket 34 coupled to the portion 42 of the perimeter 26 of the freezer compartment 16 may be compressed along the first and second segments 150*a*, 150*b*. The FC foam gasket 34 disposed in the lower gap 144 may be uncompressed or partially compressed by the engagement member 50. This configuration may be advantageous for routing the heat loop 146 through the lower gap 144 without the FC foam gasket 34 substantially impinging on the heat loop 146. In another example, the engagement member 50 may include one gap or multiple gaps in the engagement surface 228 or recessed portions relative to the engagement surface 228. The recessed portions or gaps may not compress or partially compress the gaskets 30, 34. The engagement surface 228 may also not compress or fully compress the gaskets 30, 34 when the surfaces 32 include recessed portions, as discussed herein.

Referring still to FIGS. 5 and 7A-10C, the engagement members 50 may include or be configured as at least one of the FC trim breaker adapter 212, a light assembly 230, a trim breaker cover 232, also referred to as a cover 232, and a refrigerator compartment (RC) trim breaker adapter 234. Each of the engagement members is configured to couple to the trim breaker assembly 22.

The trim breaker cover 232 is generally configured to couple to the trim breaker assembly 22 along the perimeter 162 of the cabinet 12. The trim breaker cover 232 includes an outside wall 236 and a side wall 238, which generally form an L-shape. The outside wall 236 may extend proximate to or over the outer surface 44, and the side wall 238 may extend proximate to or over the side surface 46 of the trim breaker assembly 22 when the cover 232 is coupled thereto. The trim breaker cover 232 may also include a cross member portion 240 that corresponds to the cross member 140 and the mullion region 28 when coupled to the trim breaker assembly 22.

The trim breaker cover 232 may extend along the perimeters 24, 26 of the refrigerator and freezer compartments 14, 16. The outside wall 236 and/or the side wall 238 may include the engagement surface 228 to compress the foam gaskets 30, 34 to define the seals 52, 54. The outside wall 236 and/or the side wall 238 may be configured to engage the foam gaskets 30, 34 to define the seals 52, 54 along both the portions 38, 42 of the perimeter 24, 26. In some implementations, the cover 232 may be configured to engage one of either the foam gasket 30 along the perimeter 24 of the refrigerator compartment 14 and the foam gasket 34 along the perimeter 26 of the freezer compartment 16.

When the cover 232 is uncoupled or spaced from the trim breaker assembly 22 the foam gaskets 30, 34 disposed on the side surface 46, as shown in FIGS. 7A and 8A, and/or the outer surface 44, as shown in FIGS. 7B and 8B, are in an expanded or uncompressed state. When the cover 232 is coupled to the trim breaker assembly 22 the foam gaskets 30, 34 disposed on the side surface 46, as shown in FIGS. 9A and 10A, and/or the outer surface 44, as shown in FIGS. 9B and 10B, are in a compressed state and define the seals 52, 54. The seals 52,54 defined between the trim breaker assembly 22 and the cover 232 reduce or prevent air infiltration from outside the cabinet 12, between the trim breaker assembly 22 and the engagement member 50, and to the compartments 14, 16.

Referring to FIGS. 5, 7C, and 9C, the light assembly 230 is generally configured to couple to the trim breaker assembly 22 along the perimeter 24 of the refrigerator compartment 14. The light assembly 230 is configured to selectively provide light to the refrigerator compartment 14. The light assembly 230 may provide light to the refrigerator compartment 14 when the first insulated door 70*a* is open. The light assembly 230 may include a housing 250, a light source 252, and a lens portion 254. The housing 250 is configured to couple the light assembly 250 to the trim breaker assembly 22. The light source 252 is configured to provide the light to the refrigerator compartment 14 and may be a Light Emitting Diode (LED) or other light sources. The lens portion 254 is configured to disperse the light produced by the light source 252 throughout the refrigerator compartment 14. The light assembly 230 generally includes the engagement surface 228 on the housing 250 to compress the foam gasket 30*c*.

The light assembly 230 may be coupled to the trim breaker assembly 22 along the portion 38 of the perimeter 24. The light assembly 230 may also be coupled to the trim breaker assembly 22 along the full perimeter 24 of the refrigerator compartment 14. When the light assembly 230 is uncoupled or spaced from the trim breaker assembly 22, as shown in FIG. 7C, the foam gasket 30*c* is in an expanded or uncompressed state. When the light assembly 230 is coupled to the trim breaker assembly 22, as shown in FIG. 9C, the foam gasket 30*c* is in a compressed state defining the seal 52 between the trim breaker assembly 22 and the light assembly 230. The light assembly 230 is generally configured to couple to the first cross-sectional profile 180 of the trim breaker assembly 22 but is not limited to such configurations. The light assembly 230, or an additional lighting assembly 230, may be configured to couple to the second cross-sectional profile 182 to illuminate the freezer compartment 16 without departing from the teachings herein.

In some implementations, the foam gasket 30*c* disposed on the inner surface 48 may be configured to be compressed by the RC trim breaker adapter 234. The RC trim breaker adapter 234 may be configured to couple the heat loop 146, the light assembly 230, or other components to the first cross-sectional profile 180 of the trim breaker assembly 22. The RC trim breaker adapter 234 when coupled to the trim breaker assembly 22 may compress the foam gasket 30*c* to define the seal 52 between the trim breaker assembly 22 and the RC trim breaker adapter 234. The RC trim breaker adapter 234 may be configured similarly to the FC trim breaker adapter 212, as discussed further herein.

Referring to FIGS. 5, 8C, and 10C, the FC trim breaker adapter 212 is generally configured to engage and couple with the trim breaker assembly 22. The FC trim breaker adapter 212 may be configured to couple the heat loop 146 of other components to the second cross-sectional profile 182 of the trim breaker assembly 22. The FC trim breaker adapter 212 may couple to the trim breaker assembly 22 by engaging the receiving recess 210 of the trim breaker assembly 22. The FC trim breaker adapter 212 may extend along the portion 42 of the perimeter 26 of the freezer compartment 16. The FC trim breaker adapter 212 may also extend along the full perimeter 26 of the freezer compartment 16. When the FC trim breaker adapter 212 is uncoupled or spaced from the trim breaker assembly 22, as shown in FIG. 8C, the foam gasket 34*c* disposed on the inner surface 48 is in an expanded or uncompressed state. When the trim breaker adapter 212 is coupled to the trim breaker assembly 22, as shown in FIG. 10C, the foam gasket 34*c* disposed on the inner surface 48 is in a compressed state defining the seal 54 between the FC trim breaker adapter 212 and the trim breaker assembly 22.

Figure 11A:
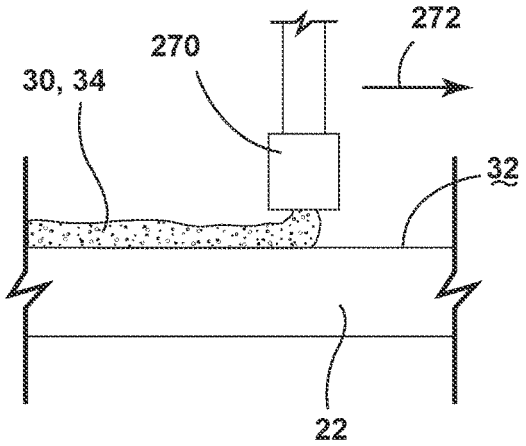
FIG. 11A is a schematic elevational view of a foam gasket being applied to a trim breaker assembly with a foam nozzle, according to the present disclosure.
Figure 11B:
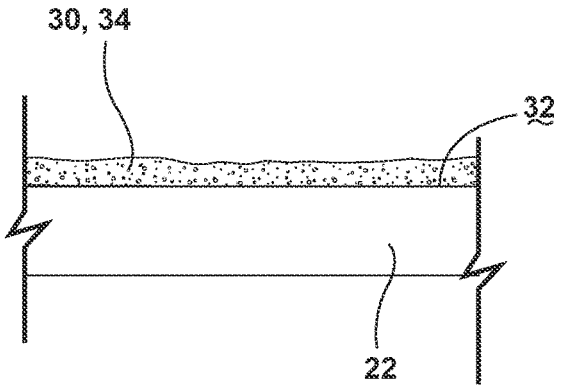
FIG. 11B is a schematic elevational view of a foam gasket applied to a trim breaker assembly, according to the present disclosure.
Figure 11C:
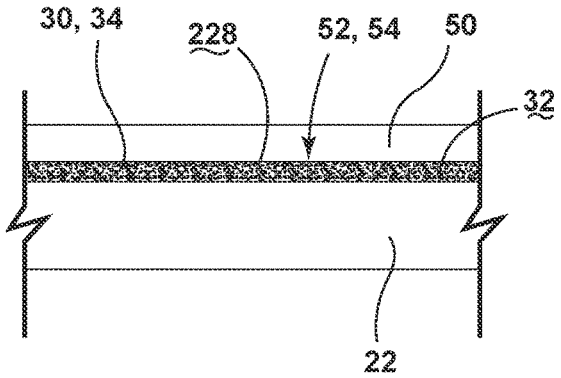
FIG. 11C is a schematic elevational view of a compressed foam gasket between a trim breaker assembly and an engagement member, according to the present disclosure.

Referring to FIGS. 11A-11C, the foam gaskets 30, 34 are applied to the surface 32 or surfaces 32 of the trim breaker assembly 22 using a foam nozzle 270 configured to be adjusted around the perimeters 24, 26 of the compartments 14, 16 and/or the perimeter 162 of the cabinet 12. The foam nozzle 270 may be coupled to a linear robot or other machines that are configured to move the foam nozzle 270 along a defined path 272. The foam nozzle 270 may be routed around the defined path 272 to apply the foam gaskets 30, 34 to the surfaces 32 of the trim breaker assembly 22 and along the perimeters 24, 26 or portions 38, 42 of the perimeters 24, 26 of the compartments 14, 16. The foam gaskets 30, 34 are applied directly to the surfaces 32 from the foam nozzle 270.

The foam gaskets 30, 34 may be applied in a continuous or a non-continuous manner. For example, the foam gasket 30 may be applied along the portion 38 of the perimeter 24 without breaks in the foam gaskets 30, 34. The continuous foam gasket 30 may assist in preventing air intrusion between the trim breaker assembly 22 and the engagement member 50. In another example, the foam gasket 34 may be applied along the portion 42 of the perimeter 26 with a gap corresponding to the lower gap 144 of the trim breaker assembly 22. The non-continuous foam gasket 34 may assist in preventing air intrusion between the trim breaker assembly 22 and the engagement member 50 while also maximizing the efficiency of the manufacturing process. Both the continuous and non-continuous laying of the foam gaskets 30, 34 may be used while laying the foam gaskets 30, 34 on the trim breaker assembly 22.

The foam gaskets 30, 34 are generally dispensed in an uncured state and undergo a curing process resulting in a cured state. In the uncured state the foam gaskets 30, 34 may be a liquid, a fluid, or a semi-solid where the foam gaskets 30, 34 may be directed to a specific location through the foam nozzle 270. In the uncured state the foam gaskets 30, 34 have not undergone the curing process or have partially undergone the curing process. The foam gaskets 30, 34 may undergo the curing process as it is dispensed by the foam nozzle 270 causing the surface of the foam gaskets 30, 34 to cure preventing the foam gaskets 30, 34 from flowing off the surface 32 of the trim breaker assembly 22. In some implementations, the foam gaskets 30, 34 may have a high-surface tension to reduce or prevent the flow of the foam gaskets 30, 34 in the uncured state. In the cured state the foam gaskets 30, 34 are generally set as a solid or semi-solid, and the curing process has substantially completed (i.e., the chemical reaction has completed or reached an equilibrium).

The foam gaskets 30, 34 may undergo the curing process once introduced to an atmosphere or being subject to an activated curing process, such as using light (i.e., ultraviolet light) or introducing a catalyst. In some implementations, the foam gaskets 30, 34 may be a two-part mix where the curing process begins when a first component and a second component are mixed, causing a chemical reaction to begin. The foam gaskets 30, 34 may expand during the curing process to provide for an open cell structure, a closed cell structure, or a mixed cell structure (i.e., a mix of an open cell structure and a closed cell structure) in the cured state. The foam gaskets 30, 34 may form the structure by producing a gas as a byproduct of the chemical reaction. A gas may also be introduced while dispensing the foam gaskets 30, 34 when the chemical reaction does not produce or produce enough gas as a byproduct to create the desired structure. The gas introduced or formed as a byproduct may foam up the foam gaskets 30, 34 to from the open cells structure, the closed cell structure, or the mixed cell structure. The foam gaskets 30, 34 may include two components, a polyol, which may be a polyurethane polyol, and an isocyanate. The foam gaskets 30, 34 may be a polyurethane foam that includes a polyurethane polyol and an isocyanate in the uncured state.

During the curing process, the foam gaskets 30, 34 may adhere to the trim breaker assembly 22. The foam gaskets 30, 34 may chemically react with the trim breaker assembly 22 creating a chemical bond and/or mechanically couple to the trim breaker assembly 22. The foam gaskets 30, 34 generally cure to a soft foam state allowing for the foam gaskets 30, 34 to be compressed while also providing an outward biasing force to maintain an engagement with the compressing engagement member 50.

As illustrated in FIG. 11B, once the foam gaskets 30, 34 have been dispensed and are in the cured state, the foam gaskets 30, 34 are uncompressed and coupled to the surface 32 of the trim breaker assembly 22. The foam gaskets 30, 34 may be compressed by the engagement member 50, as illustrated in FIG. 11C, to create the seals 52, 54. The foam gaskets 30, 34, when compressed, close any open cell structures and prevent or reduce air infiltration therethrough. In some implementations, the engagement member 50 may be coupled to the trim breaker assembly 22 when the foam gaskets 30, 34 are in the uncured state. The foam gaskets 30, 34 may cure and mechanically or chemically adhere to the engagement member 50.

Figure 12:
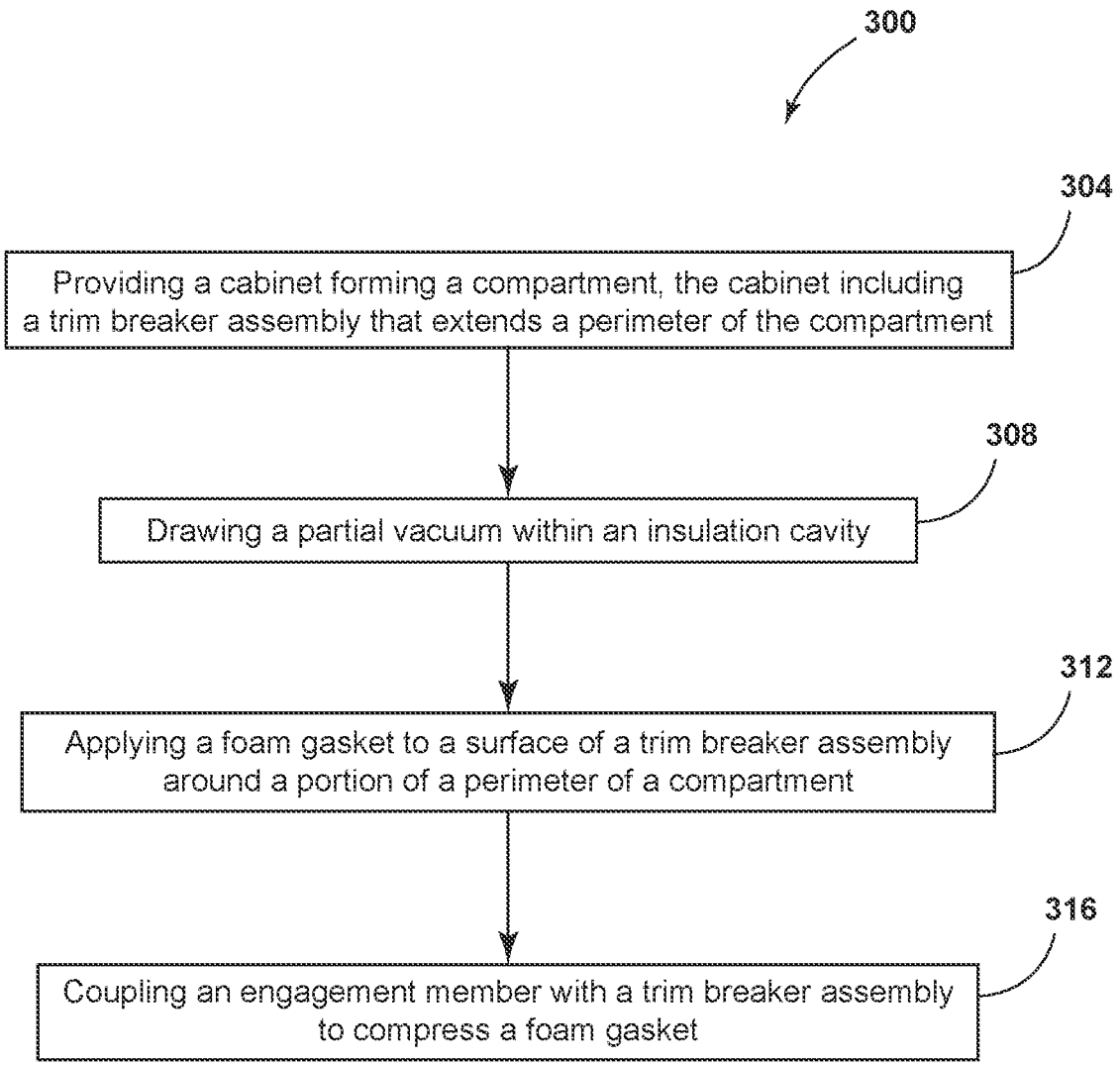
FIG. 12 is a flow diagram of a method of manufacturing a vacuum insulated structure, according to the present disclosure.

Referring to FIG. 12, and with further reference to FIGS. 1-11C, a flow diagram of a method 300 for manufacturing the vacuum insulated structure including at least one of the RC foam gasket 30 and the FC foam gasket 34 is illustrated. The method includes step 304 of providing the cabinet 12 including the insulation cavity 80 and having at least one of the refrigerator compartment 14 or the freezer compartment 16. The cabinet 12 includes the trim breaker assembly 22 that extends along the perimeter 24, 26 of the at least one compartment 14, 16. At step 308, the at least partial vacuum 90 is drawn in the insulation cavity 80. The partial vacuum 90 may be a predetermined pressure.

In step 312, at least one of the foam gaskets 30, 34 is applied to the trim breaker assembly 22. Step 312 may also include applying both foam gaskets 30, 34 to the trim breaker assembly 22. The foam gaskets 30, 34 may be applied to the portions 38, 42 of the perimeters 24, 26 of the compartments 14, 16, respectively. The at least one foam gasket 30, 34 may also include one or more of the plurality of RC foam gaskets 30*a*-30*c* and/or one or more the plurality of FC foam gaskets 34*a*-34*c*. In step 316, the engagement member 50 is coupled to the trim breaker assembly 22 to compress the foam gaskets 30, 34 to define the seals 52, 54. The seals 52, 54 reduce air infiltration between the engagement member 50 and the trim breaker assembly 22. The steps of the method 300 may be performed in any order, simultaneously, concurrently, repeated, omitted, etc. without departing from the teachings herein.

Use of the present device may provide a variety of advantages. For example, the foam gaskets 30, 34 assist in reducing or preventing air infiltration between the engagement member 50 and the trim breaker assembly 22. The foam gaskets 30, 34 form the seals 52, 54 when compressed by the engagement member 50. The seals 52, 54 may reduce air infiltration from outside the cabinet to the compartments 14, 16. The seals 52, 54 fill any gap that may be present between the trim breaker assembly 22 and the engagement member 50. The reduced air infiltration may assist in reducing the amount of heat transfer from the local environment outside the appliance 10 and the inside of the appliance 10 and may assist in maximizing energy efficiency. Further, the foam gaskets 30, 34 being laid by the foam nozzle 270 may also allow for the seals 52, 54 to be continuous or have minimized joints or gaps along the portions 38, 42 of the perimeters 24, 26, thereby maximizing the reduction of air infiltration. The foam nozzle 270 may also increase efficiency in the manufacturing process of the appliance 10 by forming the foam gaskets 30, 34 directly on the trim breaker assembly 22. Additional benefits or advantages may be realized and/or achieved.

The device disclosed herein is further summarized in the following paragraphs and is further characterized by combinations of any and all of the various aspects described herein.

According to an aspect of the present disclosure, a vacuum insulated refrigerator includes a cabinet defining a refrigerator compartment. The cabinet includes a liner, a wrapper, and a trim breaker assembly coupled to the liner and the wrapper. The trim breaker assembly extends along a perimeter of the refrigerator compartment. The trim breaker assembly includes a mullion region. At least one foam gasket is coupled to at least one surface of the trim breaker assembly. The at least one foam gasket is routed from a first end of the mullion region, along a portion of the perimeter of the refrigerator compartment, and to a second end of the mullion region. The at least one surface of the trim breaker assembly is at least one of an outer surface, a side surface, and an inner surface. At least one engagement member is configured to couple to the trim breaker assembly and define a seal by compressing the at least one foam gasket between the at least one engagement member and the trim breaker assembly.

According to another aspect, at least one engagement member is at least one of a cover extending around a perimeter of a cabinet and includes an outside wall and a side wall, where the outside wall extends over an outer surface of a trim breaker assembly and the side wall extends over a side surface of the trim breaker assembly, and a light assembly coupled to a trim breaker assembly along at least a portion of a perimeter of a refrigerator compartment and to selectively illuminate the refrigerator compartment.

According to yet another aspect, at least one foam gasket extends along an outer surface of a trim breaker assembly. At least one engagement member includes a cover, where an outside wall of the cover compresses the at least one foam gasket to define a seal.

According to yet another aspect, at least one foam gasket extends along a side surface of a trim breaker assembly. At least one engagement member includes a cover, where a side wall of the cover compresses the at least one foam gasket to define a seal.

According to yet another aspect, at least one foam gasket extends along an inner surface. At least one engagement member includes a light assembly, where the light assembly compresses the at least one foam gasket to define a seal.

According to yet another aspect, a cabinet further defines a freezer compartment and a trim breaker assembly extends along a perimeter of the freezer compartment. At least one foam gasket includes a refrigerator compartment foam gasket coupled to at least one surface of the trim breaker assembly. The refrigerator compartment foam gasket is routed from a first end of a mullion region, along a portion of a perimeter of a refrigerator compartment, and to a second end of the mullion region. A freezer compartment foam gasket is coupled to the at least one surface of the trim breaker assembly. The freezer compartment foam gasket is routed from the first end of the mullion region, along a portion of the perimeter of the freezer compartment, and to the second end of the mullion region.

According to yet another aspect, at least one engagement member is at least one of a cover extending along a perimeter of a cabinet and including an outside wall and a side wall, where the outside wall extends over an outer surface of a trim breaker assembly and the side wall extends over a side surface of the trim breaker assembly, a light assembly coupled to a trim breaker assembly along at least a portion of a perimeter of a refrigerator compartment and configured to selectively illuminate a refrigerator compartment, and a trim breaker adapter coupled to the trim breaker assembly along at least a portion of a perimeter of a freezer compartment.

According to yet another aspect, each of a refrigerator compartment foam gasket and a freezer compartment foam gasket extends along a side surface of a trim breaker assembly. At least one engagement member includes a cover, where a side wall of the cover compresses the refrigerator compartment foam gasket and the freezer compartment foam gasket to define a seal.

According to yet another aspect, at least one foam gasket is a polyurethane foam.

According to another aspect of the present disclosure, a vacuum insulated appliance includes a structural wrapper defining a freezer compartment. A trim breaker assembly is coupled to the structural wrapper. An insulation cavity is defined between the structural wrapper and the trim breaker assembly. The trim breaker assembly defines a perimeter of the freezer compartment and includes a mullion region. At least one foam gasket is coupled to at least one surface of the trim breaker assembly. The at least one foam gasket is routed from a first end of the mullion region, along a portion of the perimeter of the freezer compartment, and to a second end of the mullion region. The at least one surface of the trim breaker assembly includes at least one of an outer surface, a side surface, and an inner surface. At least one engagement member is coupled to the trim breaker assembly and define a seal by compressing the at least one foam gasket between the at least one engagement member and the trim breaker assembly to reduce air infiltration into the freezer compartment.

According to yet another aspect, at least one engagement member is at least one of a cover extends along a perimeter of the cabinet and including an outside wall and a side wall, where the outside wall extends over an outer surface of a trim breaker assembly and the side wall extends over a side surface of the trim breaker assembly, and a trim breaker adapter coupled to the trim breaker assembly along at least the portion of a perimeter of a freezer compartment.

According to yet another aspect, at least one foam gasket extends along an outer surface of a trim breaker assembly. At least one engagement member includes a cover, where an outside wall of the cover compresses at least one foam gasket to define a seal.

According to yet another aspect, at least one foam gasket extends along a side surface of a trim breaker assembly. At least one engagement member includes a cover, where a side wall of the cover compresses the at least one foam gasket to define a seal.

According to yet another aspect, at least one foam gasket extends along an inner surface of a trim breaker assembly. At least one engagement member includes a trim breaker adapter, where the trim breaker adapter compresses the at least one foam gasket to define a seal.

According to yet another aspect, at least one foam gasket includes a first segment extending along a portion of a perimeter of a freezer compartment from a first end of a mullion region to a gap defined by a trim breaker assembly, and a second segment extending along the portion of the perimeter the freezer compartment from the gap to a second end of the mullion region.

According to yet another aspect of the present disclosure, a method for manufacturing a vacuum insulated structure includes providing a cabinet defining an insulation cavity and forming at least one compartment, the cabinet including a trim breaker assembly that extends along a perimeter of the at least one compartment, drawing an at least partial vacuum within the insulating cavity, applying at least one foam gasket to at least one surface of the trim breaker assembly along at least a portion of the perimeter of the at least one compartment, and coupling at least one engagement member with the trim breaker assembly to compress the at least one foam gasket therebetween and define a seal to reduce air infiltration between the at least one engagement member and the trim breaker assembly into the at least one compartment.

According to yet another aspect, a method includes applying at least one foam gasket to at least one surface of a trim breaker assembly includes applying a first foam gasket of the at least one foam gasket to an outer surface of the at least one surface of the trim breaker assembly along a portion of a perimeter of at least one compartment, and applying a second foam gasket of the at least one foam gasket to an inner surface of the at least one surface of the trim breaker assembly along the portion of the perimeter of the at least one compartment.

According to yet another aspect, at least one engagement member includes a cover and a light assembly, and a method includes coupling the at least one engagement member with a trim breaker assembly to compress at least one foam gasket includes coupling the cover with the trim breaker assembly to compress a first foam gasket between the cover and an outer surface, and coupling the light assembly with the trim breaker assembly to compress a second foam gasket between the light assembly and an inner surface.

According to yet another aspect, a method includes applying at least one foam gasket to at least one surface of a trim breaker assembly includes applying a first foam gasket of the at least one foam gasket to the at least one surface of the trim breaker assembly along a portion of a perimeter of a first compartment of at least one compartment, and applying a second foam gasket of at least one foam gasket to the at least one surface of the trim breaker assembly along a portion of a perimeter of a second compartment of the at least one compartment.

According to yet another aspect, at least one engagement member includes a cover, and a method includes coupling the at least one engagement member with a trim breaker assembly to compress at least one foam gasket therebetween includes coupling the cover to the trim breaker assembly to compress a first foam gasket and a second foam gasket between the trim breaker assembly and the cover.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A vacuum insulated refrigerator, comprising:

a cabinet defining a refrigerator compartment, wherein the cabinet includes:

a liner;

a wrapper; and a trim breaker assembly coupled to the liner and the wrapper, wherein the trim breaker assembly extends along a perimeter of the refrigerator compartment, and wherein the trim breaker assembly includes a mullion region;

at least one foam gasket coupled to at least one surface of the trim breaker assembly, wherein the at least one foam gasket is routed from a first end of the mullion region, along a portion of the perimeter of the refrigerator compartment, and to a second end of the mullion region, wherein the at least one surface of the trim breaker assembly is at least one of:

an outer surface;

a side surface; and an inner surface; and at least one engagement member configured to couple to the trim breaker assembly and define a seal by compressing the at least one foam gasket between the at least one engagement member and the trim breaker assembly.

2. The vacuum insulated refrigerator of claim 1, wherein the at least one engagement member is at least one of:

a cover extending along a perimeter of the cabinet and includes an outside wall and a side wall, wherein the outside wall extends over the outer surface of the trim breaker assembly and the side wall extends over the side surface of the trim breaker assembly; and a light assembly coupled to the trim breaker assembly along at least the portion of the perimeter of the refrigerator compartment and to selectively illuminate the refrigerator compartment.

3. The vacuum insulated refrigerator of claim 2, wherein the at least one foam gasket extends along the outer surface, and wherein the at least one engagement member includes the cover, and further wherein the outside wall of the cover compresses the at least one foam gasket to define the seal.

4. The vacuum insulated refrigerator of claim 2, wherein the at least one foam gasket extends along the side surface, and wherein the at least one engagement member includes the cover, and further wherein the side wall of the cover compresses the at least one foam gasket to define the seal.

5. The vacuum insulated refrigerator of claim 2, wherein the at least one foam gasket extends along the inner surface, and wherein the at least one engagement member includes the light assembly, and further wherein the light assembly compresses the at least one foam gasket to define the seal.

6. The vacuum insulated refrigerator of claim 1, wherein the cabinet further defines a freezer compartment and the trim breaker assembly extends along a perimeter of the freezer compartment, and wherein the at least one foam gasket includes:

a refrigerator compartment foam gasket coupled to the at least one surface of the trim breaker assembly, wherein the refrigerator compartment foam gasket is routed from the first end of the mullion region, along the portion of the perimeter of the refrigerator compartment, and to the second end of the mullion region; and a freezer compartment foam gasket coupled to the at least one surface of the trim breaker assembly, wherein the freezer compartment foam gasket is routed from the first end of the mullion region, along a portion of the perimeter of the freezer compartment, and to the second end of the mullion region.

7. The vacuum insulated refrigerator of claim 6, wherein the at least one engagement member is at least one of:

a cover extending along a perimeter of the cabinet and including an outside wall and a side wall, wherein the outside wall extends over the outer surface of the trim breaker assembly and the side wall extends over the side surface of the trim breaker assembly;

a light assembly coupled to the trim breaker assembly along at least the portion of the perimeter of the refrigerator compartment and configured to selectively illuminate the refrigerator compartment; and a trim breaker adapter coupled to the trim breaker assembly along at least the portion of a perimeter of the freezer compartment.

8. The vacuum insulated refrigerator of claim 7, wherein each of the refrigerator compartment foam gasket and the freezer compartment foam gasket extends along the side surface of the trim breaker assembly, and wherein the at least one engagement member includes the cover, and further wherein the side wall of the cover compresses the refrigerator compartment foam gasket and the freezer compartment foam gasket to define the seal.

9. The vacuum insulated refrigerator of claim 1, wherein the at least one foam gasket is a polyurethane foam.

10. A vacuum insulated appliance, comprising:

a structural wrapper defining a freezer compartment;

a trim breaker assembly coupled to the structural wrapper, an insulation cavity defined between the structural wrapper and the trim breaker assembly, wherein the trim breaker assembly defines a perimeter of the freezer compartment and includes a mullion region;

at least one foam gasket coupled to at least one surface of the trim breaker assembly, wherein the at least one foam gasket is routed from a first end of the mullion region, along a portion of the perimeter of the freezer compartment, and to a second end of the mullion region, and wherein the at least one surface of the trim breaker assembly includes at least one of:

an outer surface;

a side surface; and an inner surface; and at least one engagement member coupled to the trim breaker assembly to define a seal by compressing the at least one foam gasket between the at least one engagement member and the trim breaker assembly to reduce air infiltration into the freezer compartment.

11. The vacuum insulated appliance of claim 10, wherein the at least one engagement member is at least one of:

a cover extending along a perimeter of the structural wrapper and including an outside wall and a side wall, wherein the outside wall extends over the outer surface of the trim breaker assembly and the side wall extends over the side surface of the trim breaker assembly; and a trim breaker adapter coupled to the trim breaker assembly along at least the portion of the perimeter of the freezer compartment.

12. The vacuum insulated appliance of claim 11, wherein the at least one foam gasket extends along the outer surface of the trim breaker assembly, and wherein the at least one engagement member includes the cover, and further wherein the outside wall of the cover compresses the at least one foam gasket to define the seal.

13. The vacuum insulated appliance of claim 11, wherein the at least one foam gasket extends along the side surface of the trim breaker assembly, and wherein the at least one engagement member includes the cover, and further wherein the side wall of the cover compresses the at least one foam gasket to define the seal.

14. The vacuum insulated appliance of claim 11, wherein the at least one foam gasket extends along the inner surface of the trim breaker assembly, and wherein the at least one engagement member includes the trim breaker adapter, and further wherein the trim breaker adapter compresses the at least one foam gasket to define the seal.

15. The vacuum insulated appliance of claim 10, wherein the at least one foam gasket includes a first segment extending along the portion of the perimeter of the freezer compartment from the first end of the mullion region to a gap defined by the trim breaker assembly and a second segment extending along the portion of the perimeter of the freezer compartment from the gap to the second end of the mullion region.

* * * * *